US011345521B1

(12) United States Patent
Moroz et al.

(10) Patent No.: US 11,345,521 B1
(45) Date of Patent: May 31, 2022

(54) HINGED CLOSURE FOR A CONTAINER

(71) Applicant: Name Has Nothin To Do With It, LLC, Sarasota, FL (US)

(72) Inventors: Peter M. Moroz, Sarasota, FL (US); John Hansen, Sarasota, FL (US)

(73) Assignee: NAME HAS NOTHIN TO DO WITH IT, LLC, Sarasota, FL (US)

( * ) Notice: Subject to any disclaimer, the term of this patent is extended or adjusted under 35 U.S.C. 154(b) by 359 days.

(21) Appl. No.: 15/694,453

(22) Filed: Sep. 1, 2017

Related U.S. Application Data

(60) Provisional application No. 62/520,687, filed on Jun. 16, 2017, provisional application No. 62/409,675, filed on Oct. 18, 2016, provisional application No. 62/383,362, filed on Sep. 2, 2016.

(51) Int. Cl.

| | |
|---|---|
| ***B65D 6/18*** | (2006.01) |
| ***B65D 21/08*** | (2006.01) |
| ***B65D 25/10*** | (2006.01) |
| ***B65D 43/16*** | (2006.01) |
| ***B65D 43/24*** | (2006.01) |
| ***B65D 81/38*** | (2006.01) |
| ***B65D 25/28*** | (2006.01) |

(52) U.S. Cl.
CPC ..... *B65D 43/161* (2013.01); *B65D 25/28* (2013.01); *B65D 43/24* (2013.01); *B65D 81/3813* (2013.01)

(58) Field of Classification Search
CPC .. G09B 23/017; B65D 43/161; B65D 43/244; B65D 43/24; B65D 25/28; B65D 81/3813; B65D 11/1866; B65D 43/166; B65D 43/167; B65D 43/168; A45C 11/04; A45C 11/16; A45C 13/005; E05D 7/12
USPC ..... 220/215, 4.21, 4.22, 524, 848, 819, 831; 206/387.13, 387.15, 755, 518, 519, 520, 206/508, 509, 6, 6.1; 226/333, 4 F, 334, 226/337, 343; 16/373
See application file for complete search history.

(56) References Cited

U.S. PATENT DOCUMENTS

| | | | | |
|---|---|---|---|---|
| 2,474,311 | A * | 6/1949 | Graham | E05D 7/12 220/843 |
| 2,585,645 | A | 2/1952 | Freitag | |
| 3,979,007 | A | 9/1976 | Thornbloom, Jr. | |
| 4,391,386 | A * | 7/1983 | Moret | B65D 43/161 220/819 |
| 4,577,986 | A | 3/1986 | Wang | |
| 4,666,327 | A | 5/1987 | Su | |

(Continued)

*Primary Examiner* — Andrew D Perreault
(74) *Attorney, Agent, or Firm* — Frijouf, Rust & Pyle, P.A.

(57) ABSTRACT

A hinged closure is disclosed for a container. The hinged closure comprises a first closure and a second closure. An internal closure hinge pivotably couples the first closure with the second closure. An exterior closure hinge pivotably couples the second closure with the container. A first locking member is couple to the interior edge of the first closure. A second locking member is coupled to the second closure. The first locking member engages with the second locking member for preventing pivoting of the first closure relative to the second closure and covering the container chamber and prevents access into the container chamber of the container. The first locking member disengaging with the second locking member for permitting pivoting of the first closure relative to the second closure and permitting access into the container chamber of the container and defines a reduced closure height relative to the container.

9 Claims, 31 Drawing Sheets

(56) References Cited

U.S. PATENT DOCUMENTS

| | | | | |
|---|---|---|---|---|
| 4,705,187 | A * | 11/1987 | Linn | B23Q 11/0021 220/819 |
| 4,789,078 | A * | 12/1988 | Miller | B65D 43/164 220/832 |
| 5,431,298 | A | 7/1995 | Ahn et al. | |
| 5,524,761 | A | 6/1996 | Wayman | |
| 5,730,344 | A | 3/1998 | Mauch | |
| 6,644,526 | B2 | 11/2003 | Pegorier | |
| 6,742,666 | B1 * | 6/2004 | Bried | B65D 47/0833 215/235 |
| 7,451,709 | B2 | 11/2008 | Swartfager et al. | |
| 2004/0218968 | A1 | 11/2004 | Beaver et al. | |
| 2006/0283869 | A1 * | 12/2006 | Soncini | A45C 11/04 220/836 |
| 2009/0296331 | A1 | 12/2009 | Choy | |

* cited by examiner 170
84
86
80
92
152
82
240
100

170
84
80
90
92
164
152
166
82
132
100

170
84
80
92
90
82
132
112

18
170
84
92
17
170
16
80
88
86
82

132
112
80
92
82
86
88
240
100
152
162
152
162
152
162
100

100
82
164
100
90
100
88
80
86
170
84
166
170

HINGED CLOSURE FOR A CONTAINER

CROSS-REFERENCE TO RELATED APPLICATIONS

This application claims benefit of U.S. Patent Provisional Application No. 62/383,362 filed Sep. 2, 2016. All subject matter set forth in Provisional Application No. 62/383,362 is hereby incorporated by reference into the present application as if fully set forth herein.

This application claims benefit of U.S. Patent Provisional Application No. 62/409,675 filed Oct. 18, 2016. All subject matter set forth in Provisional Application No. 62/409,675 is hereby incorporated by reference into the present application as if fully set forth herein.

This application claims benefit of U.S. Patent Provisional. Application Number 62/520,687 filed Jun. 16, 2017. All subject matter set forth in Provisional Application No. 62/520,687 is hereby incorporated by reference into the present application as if fully set forth herein.

BACKGROUND OF THE INVENTION

Field of the Invention

This invention relates closures and more particularly to a hinged closure for a container.

Background of the Invention

Coolers and in particular small portable coolers, commonly referred to as picnic coolers have achieved widespread acceptance and use associated with a variety of pursuits, in both the recreational and workplace areas. The wide application of these coolers results in the coolers being placed in locations on board vessels or in vehicles that are less than desirable and provide limited access to the coolers. Hinged lids on coolers which are placed in areas with minimal vertical clearance require the cooler to be moved in order to gain access to the cooler's contents. In some heavily loaded coolers, this amounts to a large undertaking and may result in damage to the surface upon which the cooler is resting. Another problem that arises is the need to have a resting place, a table or the like upon which to rest items removed from the cooler.

There have been many in the prior art who have attempted to solve these problems with varying degrees of success. None, however completely satisfies the requirements for a complete solution to the aforestated problem. The following U. S. Patents are attempts of the prior art to solve this problem.

U. S. Pat. No. 2,585,645 to Freitag discloses a folding lid assembly for open top cabinets and particularly those for thermally insulated refrigerator cabinets.

U.S. Pat. No. 3,979,007 to Thornbloom, Jr. discloses an improved combination lid and handle assembly for a picnic cooler having hinged, double-door lid sections, each of Which cooperatingly engage a handle assembly in the raised position to support the inner surface of the lid sections in a horizontal position. This provides a table surface for the users. The handle sections have cooler side wall stops and recesses in the lid to retain the lid in the proper position preventing disengagement and spilling of objects placed on the inner table surfaces of the lid. The lid may also have recessed portions on the inner surface to receivingly retain glasses or other objects.

U.S. Pat. No. 4,391,386 to Moret discloses a handling case with incorporated foldable lid. According to the invention, the case includes a lid made of two parts hinged to one another about a hinge and which may be tipped against one another. A hook-shaped mechanism is provided on the front part of the lid which locks into slots formed in a corresponding location along the edge of the case when the lid is closed. The invention is applicable in particular to cases which can be stacked one inside the other when they are empty.

U. S. Pat. No. 4,577,986 to Wang discloses a joint mechanism comprised of two pivotally connected joint members rotatable about a common axis lockable in one of a series of predetermined positions by engagement of a spring-biased pawl provided within one joint member within notches distributed about the peripheral edge of the other joint member. An operating lever comprised of a forked release element and a handle pivotally connected together cooperates with a control means to control locking and unlocking of the joint mechanism. The control means has radially extending resilient arms formed at the free end with upturned claws Which, when projecting through slits formed in one side of the other joint member, prevents engagement of the pawl within said notches, and which, when being depressed into said slits by the release element of the operating lever, permits engagement of the pawl within the notches.

U. S. Pat. No. 4,666,327 to Su discloses a joint for foldable aluminum ladders comprising a first base, a second base, a control plate and a selecting means. The second base has a middle plate inserted between two parallel plates which are connected at the end of the first base. The control plate is inserted between one of the parallel plates and the middle plate. The parallel plates, middle plate and control plate each have a central hole to allow a sleeve to be inserted therethrough. The parallel plates, middle plate and control plate also have apertures Which lay some distance along the edges. The selecting means has a fixing link inserted through the sleeve and an inserting link which is shorter than the fixing link. A compressible spring is disposed around the lower end of the fixing link and a nut is secured at the threaded portion of the fixing link. When the selecting means is pulled outwardly, the legs of the ladder can be freely rotated to adjust the angle of the ladder, then the angle of the ladder is fixed with the inserting link being inserted through the most appropriate apertures of the first base, second base and control plate.

U.S. Pat. No. 5,431,298 to Ahm, et al. discloses a convertible multipurpose container including a container body, a pair of lids, a pan of supporting members for supporting handles, and an extra plate whereby upon outwardly opening the lids, the extra plate is combined with the lids to become a composite plate for receiving articles thereon.

U. S. Pat. No. 5,524,761 to Wayman discloses a new and improved picnic cooler comprised of an insulated container having an interior surface and an exterior surface. The exterior surface of a front wall has two securement clasps theresecured. The interior surface of the front wall and of the interior surface of a back wall, have a plurality of securement shelves secure thereto. Contained in the device is a lid having a front edge and a back edge. The back edge is hingedly secured to an upper portion of the back wall of the insulated container. The lid covers the insulated container in a closed configuration. The front edge of the lid is engaged by the two securement clasps of the insulated container when in the closed configuration. The lid has a carrying handle secured thereto. A plurality of adjustable racks are removably secured to the plurality of securement shelves of the insulated container.

U.S. Pat. No. 5,730,344 to Mauch discloses a chest for storing, carrying and serving foodstuffs specifically designed for use in conjunction with recreational activities such as tailgating. The chest includes five rigid walls defining a volume of storage space and a unique cover moveable between an open and closed position relative to the five rigid walls. The cover is pivotally mounted to one of the rigid walls and is formed of a plurality of sectional parts pivotally attached to one another. The chest also includes compartments designed for holding various items and containers. The chest can be removably and replaceably secured to the tailgate of a vehicle using a mounting structure.

U.S. Pat. No. 6,641,526 to Pegorier discloses a motor vehicle central console comprising an enclosure having a base and four lateral faces arising from the base forming an opening opposite to the base, and at least one lid comprising a recto face and a verso face, having means for coupling to the enclosure co-operating with complementary coupling means borne by the enclosure, and at least partially closing the opening. The lid is completely removable. The coupling means of the lid are completely and simply disconnectable from the complementary coupling means of the enclosure. In the mounted position, the coupling means of the lid co-operate with the complementary coupling means of the enclosure, regardless of which face of the lid is facing the base of the enclosure.

U.S. Pat. No. 7,451,709 to Swartager, et al. discloses a portable cooler and table assembly that may be easily transported in a single, self-contained unit. The assembly may be converted for use as a table for a variety of recreational activities, e.g., dining, drinking, games such as ping pong, beer pong, table hockey, card games, board games, preparation for sporting events and meals. The table and cooler may be permanently attached to each other, or alternatively, the cooler may be detachable from the table. The table may fold or collapse to assist in converting the assembly from a compact, lightweight transportable unit into a fully extended and operable table and cooler. The table surface may contain surface features such as grooves, indentations, nets, game pieces, etc. The cooler may comprise any container that is capable of containing ice or some other refrigeration or heating system, e.g., a conventional 54 quart beverage cooler. Alternatively, the cooler may be replaced with a storage container or other storage device. The assembly may also contain various wheels, legs and handles to assist in mobility and conversion.

United States Patent Application 2004/0218968 to Beaver, et al. discloses a hinge and locking assembly including first and second hinge members that, when locked, are prevented from rotating about an axis and that, when unlocked, are permitted to rotate about the axis and a lock indicator member movable between a retracted position when the hinge members are locked and an extended position when the hinge members are unlocked. A user is able to determine whether the hinge members are locked or unlocked by observing whether the lock indicator member is in the retracted position or the extended position.

United States Patent Application 2009/0296331 to Choy discloses a dual screen presentation notebook having components that are integrally connected together to allow easy viewing of presentation materials without the users having to sit side by side craning their necks close together facing the same direction but instead can face opposite one another. When the dual screen presentation notebook is switched on, users can either view identical or mirror images of the presentation materials or different images on the two monitor screens. The dual screen presentation notebook can be easily converted into a tablet computer and can also be used for other applications such as viewing electronic book, electronic photograph and images, videos, movies, etc.

Although the aforementioned prior art have contributed to the development of the art of portable coolers and in particular, portable cooler lids none of these prior art patents have solved the needs of this art.

Therefore, it is an object of the present invention to provide an improved cooler lid.

Another object of this invention is to provide an improved cooler lid that offers a variety of utilization options.

Another object of this invention is to provide an improved cooler lid that is easy for an operator to use.

Another object of this invention is to provide an improved cooler lid that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a hinged closure for a container. The container including a front wall, a rear wall, a first side wall, a second side wall and a bottom wall for defining a container chamber. The hinged closure comprises a first closure having an interior edge, an exterior edge, a first side, a second side, a lower surface and an upper surface. A second closure has an interior edge, an exterior edge, a first side, a second side, a lower surface and an upper surface. An internal closure hinge is pivotably coupling the interior edge of the first closure with the interior edge of the second closure. An exterior closure hinge is pivotably coupling the exterior edge of the second closure with the rear wall of the container. A first locking member is coupled to the interior edge of the first closure. A second locking member is coupled to the interior edge of the second closure. The first locking member engages with the second locking member for preventing pivoting of the first closure relative to the second closure and defining a linear closure within the first closure and the second closure. The linear closure covers the container chamber and prevents access into the container chamber of the container. The first locking member disengages with the second locking member for permitting pivoting of the first closure relative to the second closure and defining a nonlinear closure within the first closure and the second closure. The nonlinear closure permits access into the container chamber of the container and defines a reduced closure height relative to the container.

In a more specific embodiment of the invention, a first pivot stop is coupled to the lower surface of the first closure. A second pivot stop is coupled to the lower surface of the second closure. The first pivot stop abuts the second pivot stop when the first closure and the second closure define the nonlinear closure for defining a generally horizontal table surface on the upper surface of the first closure and permitting access into the container chamber of the container and defining the reduced closure height relative to the container.

In one embodiment of the invention, a closure stop is coupled to the exterior edge of the second closure. The closure stop abuts the rear wall of the container for terminating pivoting the second closure relative to the container and defining a generally obtuse angle between the second closure and the rear wall of the container. The generally obtuse angle maintains the generally horizontal table surface on the upper surface of the first closure during the first pivot stop abutting the second pivot stop and permitting access into the container chamber of the container and defining the reduced closure height relative to the container.

In another embodiment of the invention, a closure leg pivotably is coupled to the first closure. The closure leg has a generally vertical orientation and engages the container for supporting the linear closure in a partially opened position and permitting access into the container and defines a second reduced closure height relative to the container.

In another embodiment of the invention, the hinged closure includes the first closure having a primary corner closure, a secondary corner closure, a primary coupling leg, a secondary coupling leg and a main coupling leg. The primary coupling leg, the secondary coupling leg and the main coupling leg define a general C-shape for coupling the primary corner closure and the secondary corner closure. The second closure has an interior edge, an exterior edge, a first side, a second side, a lower surface and an upper surface. A primary notch intersects the first side and the interior edge of the second closure. A secondary notch intersects the second side and the interior edge of the second closure. A primary internal closure hinge pivotably couples the main coupling leg of the first closure with the second closure. An exterior closure hinge pivotably couples the exterior edge of the second closure with the rear wall of the container. The primary corner closure is positioned within the primary notch and the secondary corner closure is positioned within the secondary notch for defining a primary linear closure within the first closure and the second closure. The primary linear closure abuts the upper ledge for covering the container chamber and preventing access into the container chamber of the container. A first locking member is coupled to the first closure. A second locking member is coupled to the second closure. The first locking member engages with the second locking member for preventing pivoting of the first closure relative to the second closure and maintaining the primary linear closure within the first closure and the second closure. The first locking member disengages with the second locking member for permitting pivoting of the first closure relative to the second closure and defining a primary nonlinear closure within the first closure and the second closure. The primary nonlinear closure permits a closure angle between the first closure and the second closure. The closure angle and the general C-shape define a container access channel with the first closure and the front wall of the container. The container access channel permits access into the container chamber of the container and defining a reduced closure height relative to the container.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
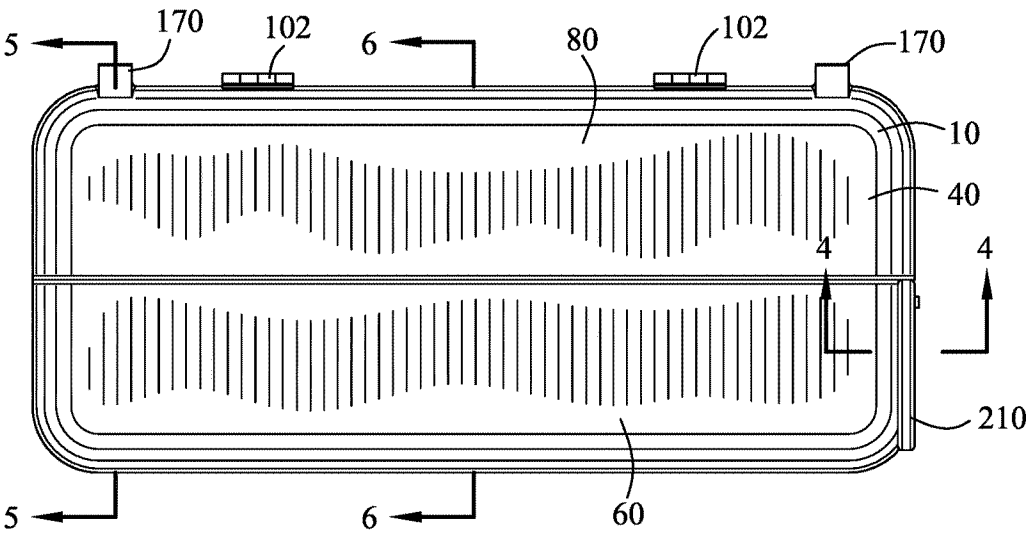
FIG. 1 is a top view of a hinged closure engaging a container incorporating the present invention.
Figure 2:
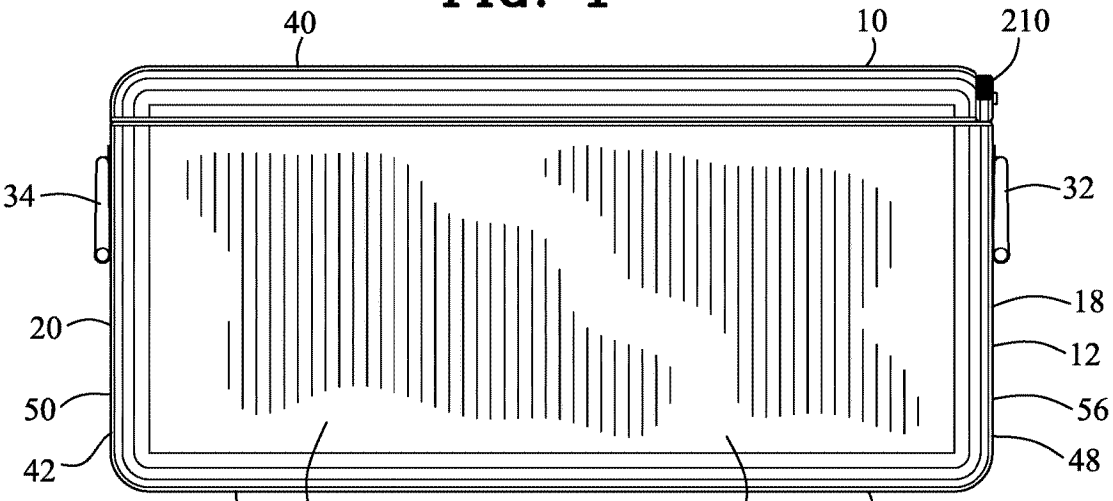
FIG. 2 is a front view of FIG. 1.
Figure 63:
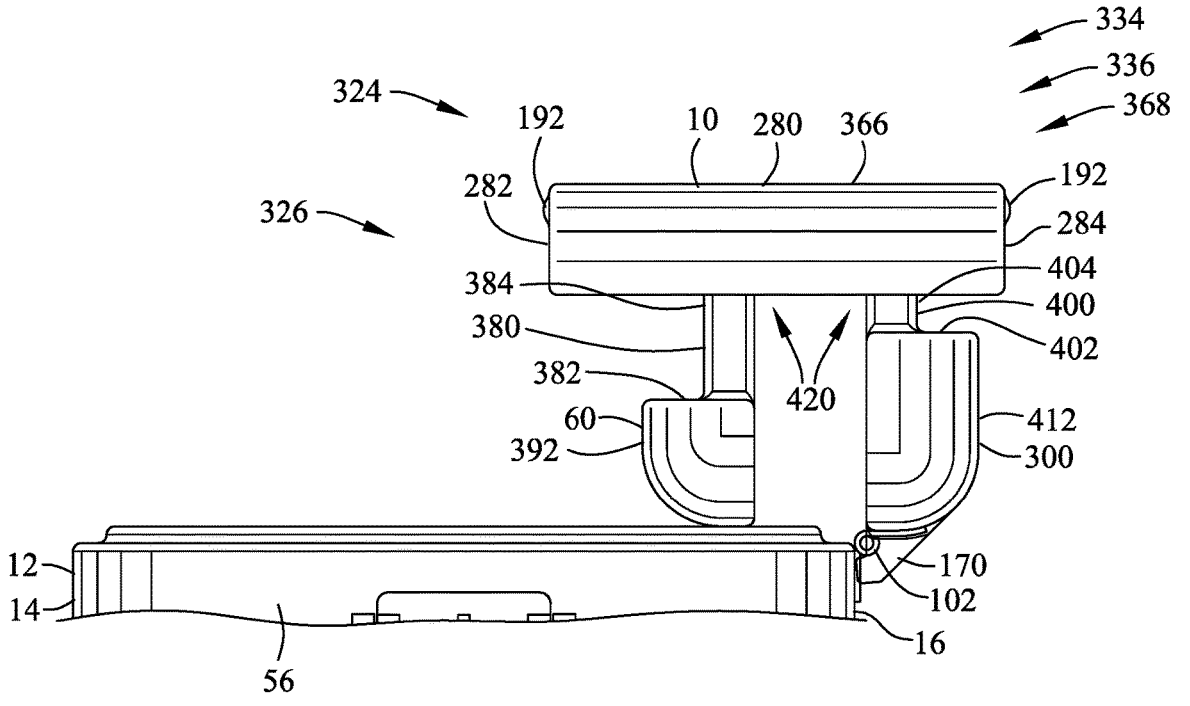
FIG. 63 is a side view of FIG. 62 illustrating the first closure and the third closure including a vertical orientation and the second closure includes a horizontal orientation for defining a generally horizontal table surface on the second closure and permitting access into the container.
Figure 64:
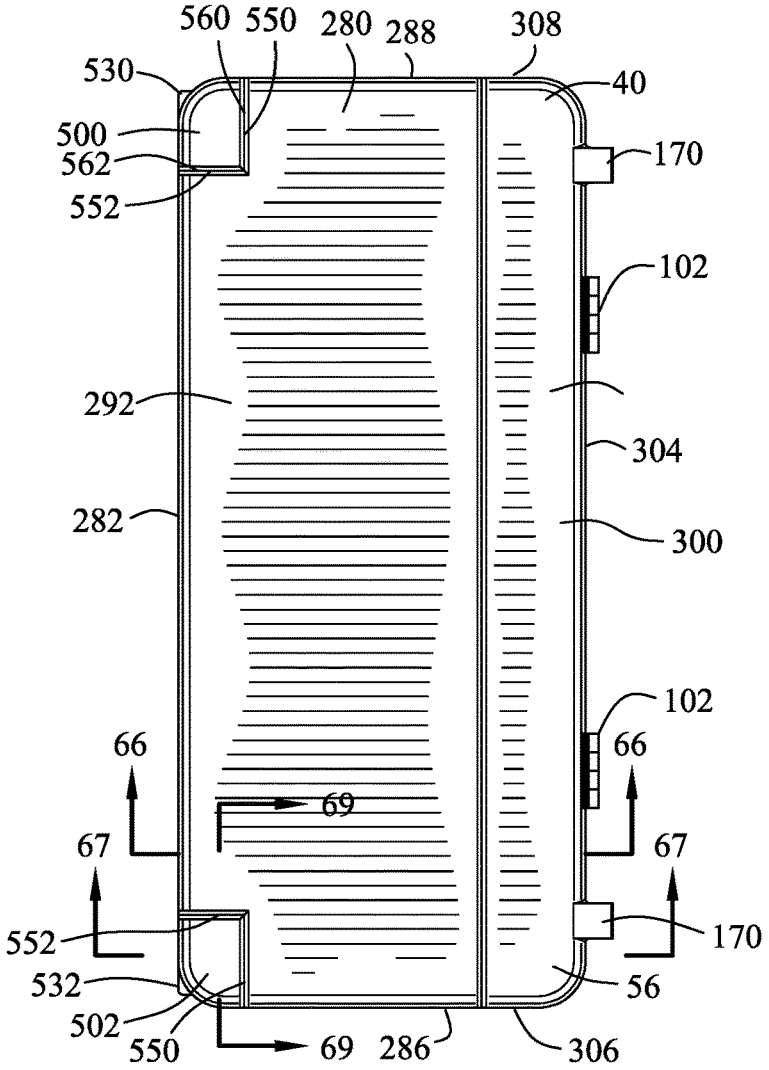
FIG. 64 is a top view of a sixth embodiment of the hinged closure engaging a container incorporating the present invention.
Figure 65:
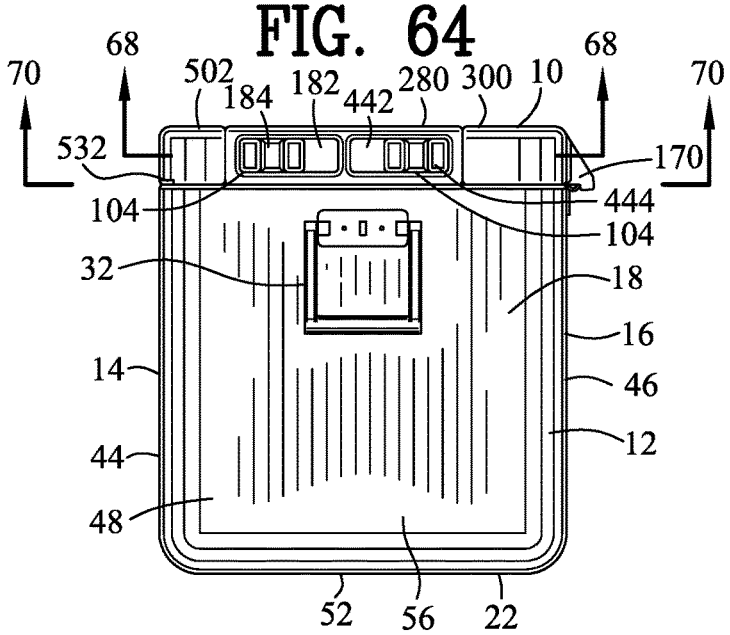
FIG. 65 is a right side view of FIG. 64.
Figure 66:
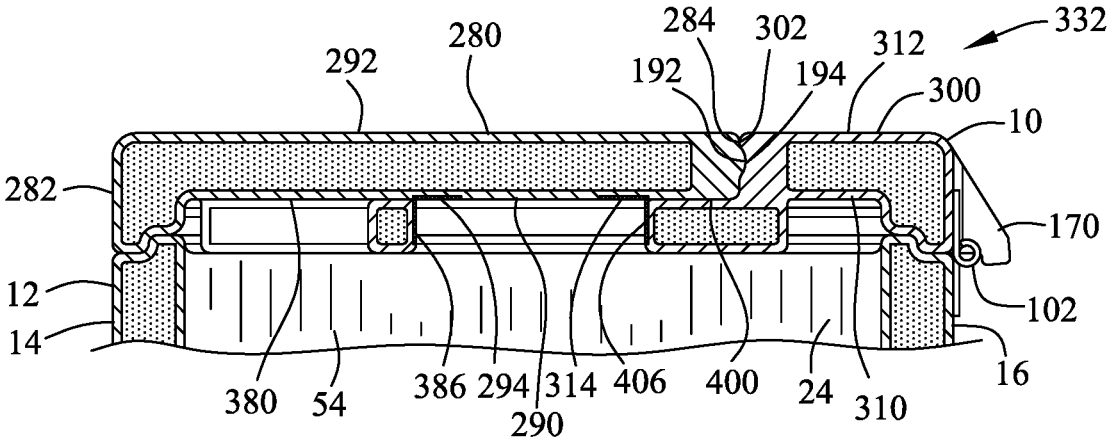
FIG. 66 is a sectional view along line 66-66 in FIG. 64.
Figure 67:
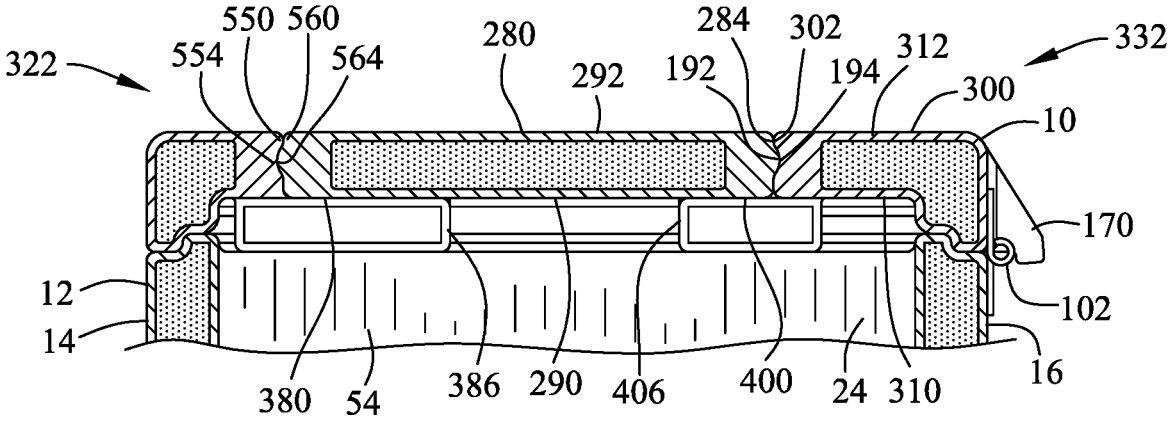
FIG. 67 is a sectional view along line 67-67 in FIG. 64.
Figure 68:
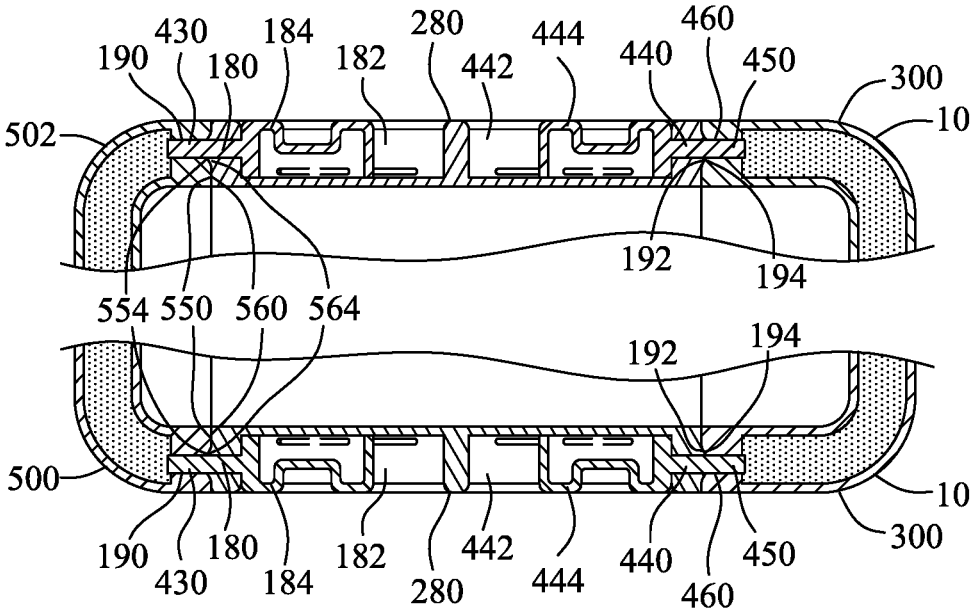
FIG. 68 is a sectional view along line 68-68 in FIG. 65.
Figure 70:
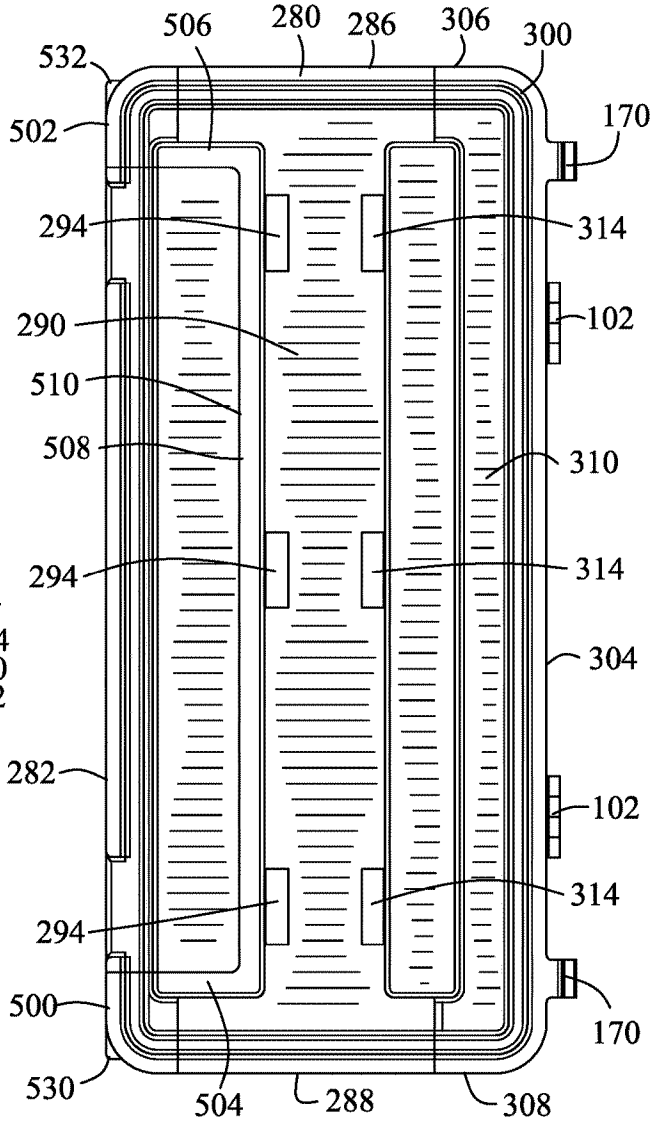
FIG. 70 is a view along line 70-70 in FIG. 65.
Figure 69:
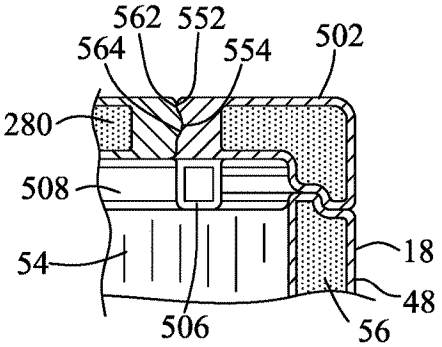
FIG. 69 is a sectional view along line 69-69 in FIG. 64.

FIGS. 1-63 illustrate a hinged closure 10 for a container 12. The container 12 includes a front wall 14, a rear wall 16, a first side wall 18, a second side wall 20 and a bottom wall 22 for defining a container chamber 24. The front wall 14, the rear wall 16, the first side wall 18 and the second side wall 20 define an upper ledge 26 and a container aperture 28. The upper ledge 26 may include a ledge step 30 for engaging the hinge closure 10. The container 12 may include a first handle 32 and a second handle 34 for assisting in the transportation of the container.

The hinged closure 10 may include an insulated hinged closure 40 for an insulated container 42. The insulated container 42 includes a front insulated wall 44, a rear insulated wall 46, a first insulated side wall 48, a second insulated side wall 50 and a bottom insulated wall 52 for defining an insulated container chamber 54. The insulated container 40 could be utilized as a cooler 56. The insulated container chamber 54 may receive an item for keeping the item cool. The item may include an edible solid and/or liquid, or other objects.

FIGS. 1-34 illustrate a first embodiment of the hinged closure 10. The hinged closure 10 comprises a first closure 60 having an interior edge 62, an exterior edge 64, a first side 66, a second side 68, a lower surface 70 and an upper surface 72. A second closure 80 having an interior edge 82, an exterior edge 84, a first side 86, a second side 88, a lower surface 90 and an upper surface 92.

An internal closure hinge 100 pivotably couples the interior edge 62 of the first closure 60 with the interior edge 82 of the second closure 80. The internal closure hinge 100 may include one or more internal closure hinges 100. An exterior closure hinge 102 pivotably coupling the exterior edge 84 of the second closure 80 with the rear wall 16 of the container 12.

A first locking member 110 is coupled to the interior edge 62 of the first closure 60. A second locking member 112 is coupled to the interior edge 82 of the second closure 80. The first locking member 110 engages with the second locking member 112 for preventing pivoting of the first closure 60 relative to the second closure 80 and defining a linear closure 120 within the first closure 60 and the second closure 80. The linear closure 120 covers the container chamber 24 and preventing access into the container chamber 24 of the container 12. The linear closure 120 covers the insulated container chamber 54 for insulating the insulated container chamber 54 and retaining a cool temperature of an edible solid and/or liquid. The first locking member 110 disengages with the second locking member 112 for permitting pivoting of the first closure 60 relative to the second closure 80 and defining a nonlinear closure 122 within the first closure 60 and the second closure 80. The nonlinear closure 122 permits access into the container chamber 24 of the container 12 and defining a reduced closure height 124 relative to the container 12. The specifically, the reduced closure height 124 is less than the height of the linear closure 120 where the second closure 80 has an equivalent angle relative to the rear wall 16.

The hinged closure 10 includes a locking member 104 extending between interior edge 62 of the first closure 60 and interior edge 82 of the second closure 80. The locking member 104 is engaged for preventing pivoting of the first closure 60 relative to the second closure 80 and defining a linear closure 120 within the first closure 60 and the second closure 80. The linear closure 120 covers the container chamber 24 and prevents access into the container chamber 24 of the container 12. The locking member 104 is disengaged for permitting pivoting of the first closure 60 relative to the second closure 80 and defining a nonlinear closure 122 within the first closure 60 and the second closure 80. The nonlinear closure 122 permits access into the container chamber 24 of the container 12 and defines a reduced closure height 124 relative to the container 12.

FIGS. 1-34 illustrate the first locking member 110 including a first male body 130 extending from the interior edge 62 of the first closure 60. The second locking member 112 may include a second female channel 132 recessed into the interior edge 82 of the second closure 80. The first male body 130 frictionally engages with the second female channel 132 for preventing pivoting of the first closure 60 relative to the second closure 80 and defining the linear closure 120 within the first closure 60 and the second closure 80. A pivotable force is applied to the first closure 60 while maintaining the second closure 80 in a static position for causing the first male body 130 to disengage with the second female channel 132 and permitting pivoting of the first closure 60 relative to the second closure 80 and defining the nonlinear closure 122 within the first closure 60 and the second closure 80.

The first male body 130 may include a base dimension 134 and a top dimension 136. Preferably, the base dimension 134 is slightly less than the top dimension 136 for defining a general male dove tale shape 138. The second female channel 132 may include an upper channel dimension 140 and a lower channel dimension 142. Preferably, the upper channel dimension 140 is slightly less than the lower channel dimension 142 for defining a general female dove tale shape 144. The engagement between the general male dove tale shape 138 and the general female dove tale shape 144 preventing inadvertent pivoting of the first closure 60 relative to the second closure 80 absent the pivotable force applied to the first closure 60 while maintaining the second closure 80 in a static position.

Figure 33:
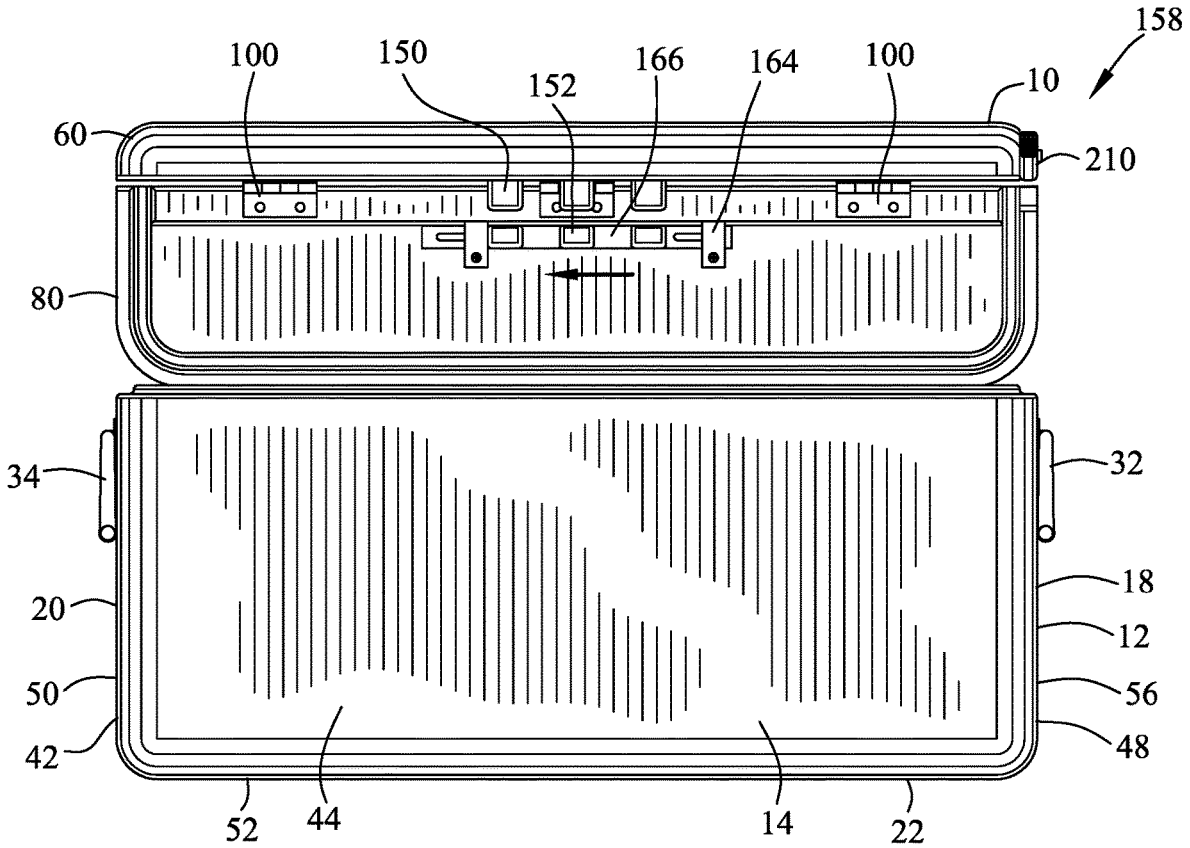
FIG. 33 is a view similar to FIG. 32 illustrating the second pivot stop being displaced relative to the second closure for aligning the first pivot stop with the second pivot stop.
Figure 34:
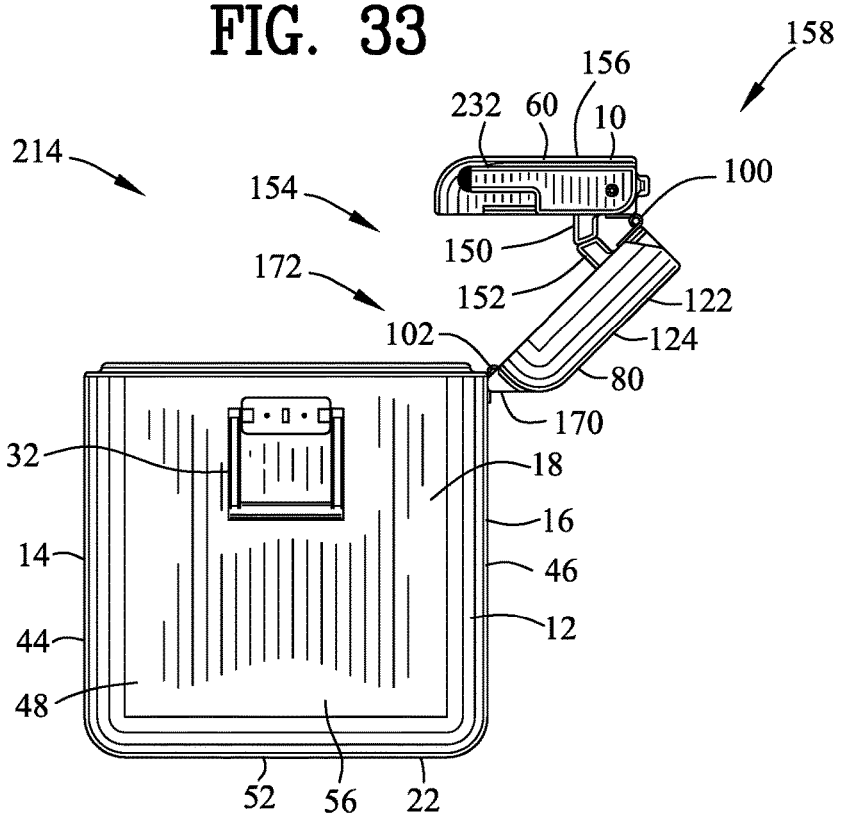
FIG. 34 is a view similar to FIG. 31 wherein the first pivot stop abuts with the second pivot stop for defining a generally horizontal table surface on the first closure and permitting access into the container.

A first pivot stop 150 may be coupled to the lower surface 70 of the first closure 60. A second pivot stop 152 may be coupled to the lower surface 90 of the second closure 80. As best shown in FIG. 34, the first pivot stop 150 abuts the second pivot stop 152 when the first closure 60 and the second closure 80 define the nonlinear closure 122. More specifically, the first pivot stop 150 abuts the second pivot stop 152 when the first closure 60 and the second closure 80 define an acute angle 154 there between. During the abutting between the first pivot stop 150 and the second pivot stop 152, a generally horizontal table surface 156 is defined on the upper surface 72 of the first closure 60 while permitting access into the container chamber 24 of the container 12 and defining the reduced closure height 124 relative to the container 12. The generally horizontal table surface 156 could be utilized for supporting the edible solid and/or liquid, or other objects that are utilized within the container 12. In addition, the generally horizontal table surface 156 could be utilized for preparing the edible solid and/or liquid, or other objects that may or may not be utilized within the container 12. Preferably, the first pivot stop 150 includes a plurality of first tabs 160 molded into the lower surface 70 of the first closure. The second pivot stop 152 may include a plurality of second tabs 162 that are slidably displaced adjacent to the lower surface 90 of the second closure 80. More specifically, the lower surface 90 of the second closure 80 may include a stop guide 164 that channels the second pivot stop 152 relative to the second closure 80. As best shown in FIGS. 29-34, the second pivot stop 152 includes a slide plate 166 that slidably engaging within the stop guide 164. A plurality of slide locks 168 retain the slide plate 166 within the second tope guide 164. The second pivot stop 152 and the slide plate 166 may be grasped while the first closure 60 and the second closure 80 has been pivoted from engagement with the container aperture 28. The second pivot stop 152 and the slide plate 166 can be slid within the stop guide 164 for positioning the second pivot stop 152 in an alignment orientation 158 with the first pivot stop 150 as shown in FIGS. 33 and 34 and permitting abutting of the first pivot stop 150 with the second pivot stop 152. Alternatively, the second pivot stop 152 and the slide plate 166 can be slid within the stop guide 164 for positioning the second pivot stop 152 in a non-alignment orientation 159 with the first pivot stop 150 as shown in FIGS. 19 and 29-32 and avoiding abutting of the first pivot stop 150 with the second pivot stop 152.

A closure stop 170 may be coupled to the exterior edge 84 of the second closure 80. As best shown in FIGS. 34, 60-63, the closure stop 170 abuts the rear wall 16 of the container 12 for terminating pivoting the second closure 80 relative to the container 12. The closure stop 170 positions the second closure 80 such that a generally obtuse angle 172 is defined between the second closure 80 and the rear wall 16 of the container 12. The generally obtuse angle 172 in conjunction with the abutment of the first pivot stop 150 and the second pivot stop 152 maintain the generally horizontal table surface 156 on the upper surface 72 of the first closure 60 and permit access into the container chamber 24 of the container 12 and define the reduced closure height 124 relative to the container 12. Preferably, the closure stop 170 is integrally formed with the second closure 80.

Figure 35:
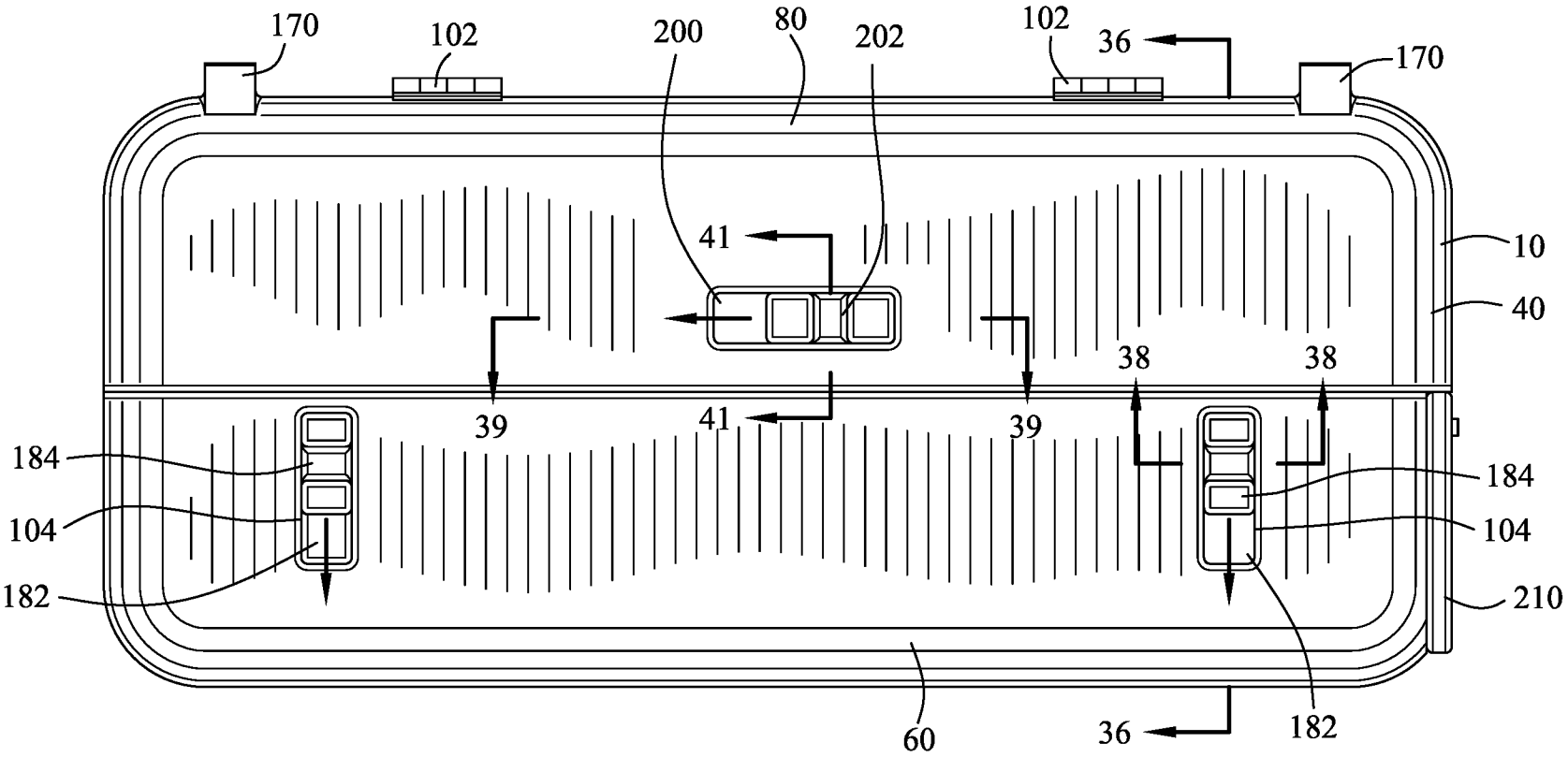
FIG. 35 is a top view of a second embodiment of the hinged closure engaging a container incorporating the present invention.
Figure 36:
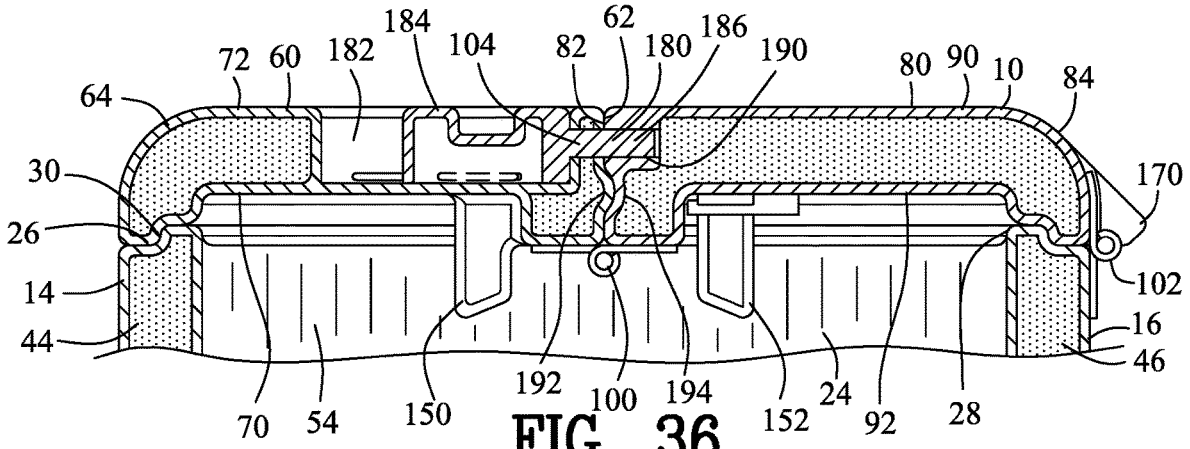
FIG. 36 is a sectional view along line 36-36 in FIG. 35.
Figure 37:
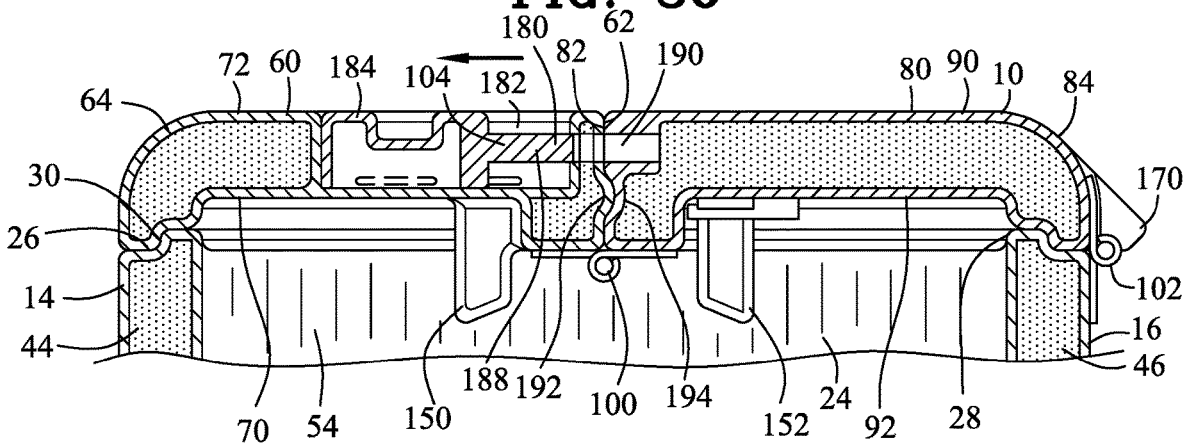
FIG. 37 is a view similar to FIG. 36 illustrating a first locking pin being removed from a pin receiver for permitting pivoting of the first closure relative to the second closure.

Alternatively, as shown in FIGS. 35-38, the first locking member 110 may include a first locking pin 180 slidably engaging within the first closure 60. A first lock actuator channel 182 is in the upper surface 72 of the first closure 60. A first actuator 184 slidably engaging within the first lock actuator channel 182. The first actuator 184 is coupled to the first locking pin 180 for positioning the first locking pin 180 between a pin extended position 186 exterior to the interior edge 62 of the first closure 60 as shown in FIG. 36 and a pin retracted position 188 interior to the interior edge 62 of the first closure 60 as shown in FIG. 37.

The second locking member 112 may include a pin receiver 190 extending from the interior edge 82 and into the second closure 80. As shown in FIG. 36, the first locking pin 180 engages within the pin receiver 190 for preventing pivoting of the first closure 60 relative to the second closure 80 for defining the linear closure 120 within the first closure 60 and the second closure 80. The first locking pin 180 disengages with the pin receiver 190 for permitting pivoting of the first closure 60 relative to the second closure 80 for defining the nonlinear closure 122 within the first closure 60 and the second closure 80. By utilizing the first actuator 184 within the first lock actuator channel 182 in the upper surface 72 of the first closure 60, permits the activation of the first locking member 110 with the second locking member 112 from the outside of the hinged closure 10. The first locking member 110 and the second locking member 112 in FIGS. 35-38 may include a plurality of first locking members 110 and second locking members 112.

As shown in FIGS. 36 and 37, the interior edge 62 of the first closure 60 may include a protruding aligning member 192 and the interior edge 82 of the second closure 80 may include a recessed aligning member 194. The protruding aligning member 192 is positioned within the recessed aligning member 194 when the first closure 60 and the second closure 80 define the linear closure 120. The engagement between the protruding aligning member 192 and the recessed aligning member 194 assist in aligning the first closure 60 relative to the second closure 80 and furthermore strengthen the coupling between the first closure 60 and the second closure 80.

Figure 39:
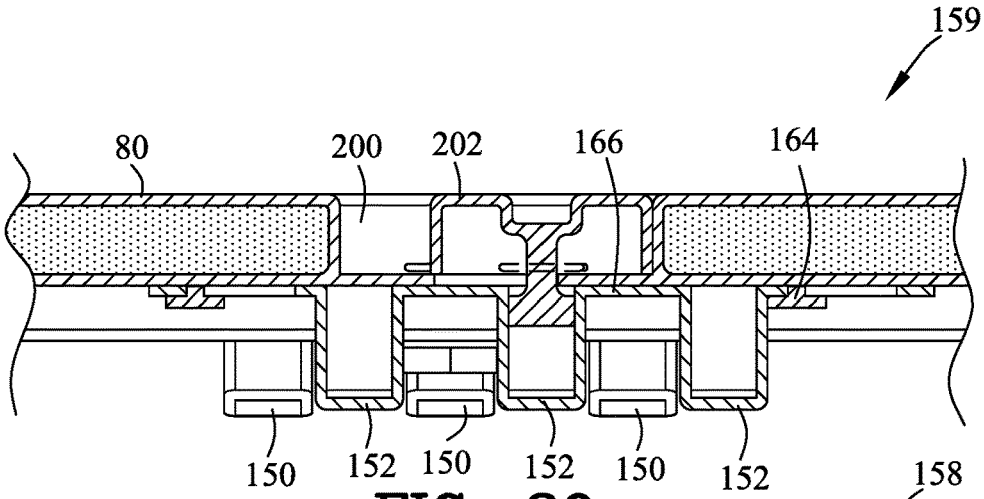
FIG. 39 is a sectional view along line 39-39 in FIG. 35 illustrating a second actuator coupled to the second pivot stop.
Figure 40:
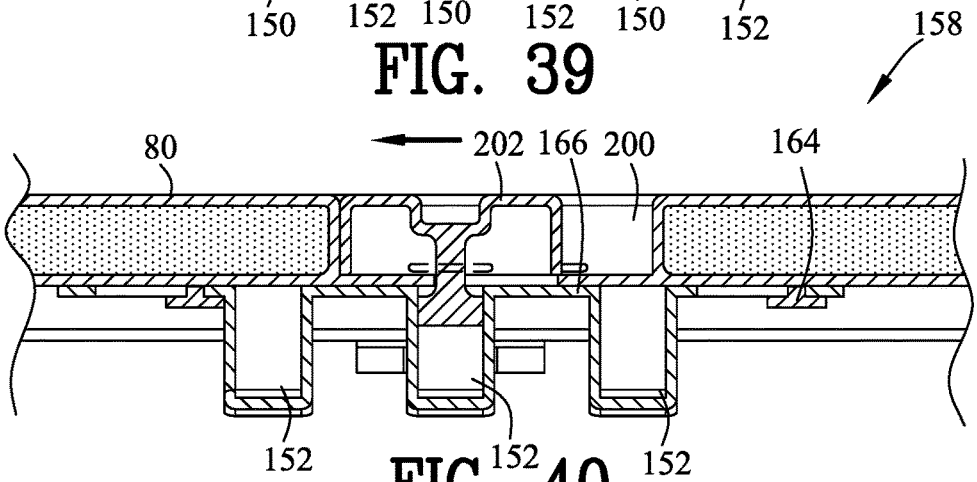
FIG. 40 is a view similar to FIG. 39 illustrating the second actuator being displaced relative to the second closure for aligning the first pivot stop with the second pivot stop.
Figure 41:
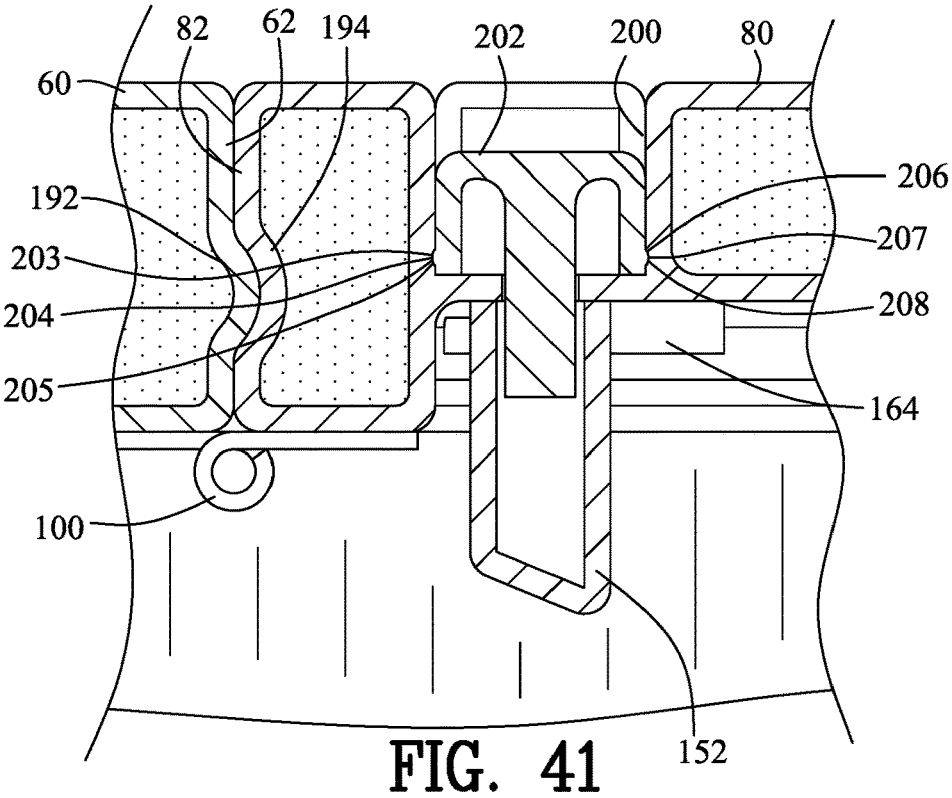
FIG. 41 is a sectional view along line 41-41 in FIG. 35.
Figure 42:
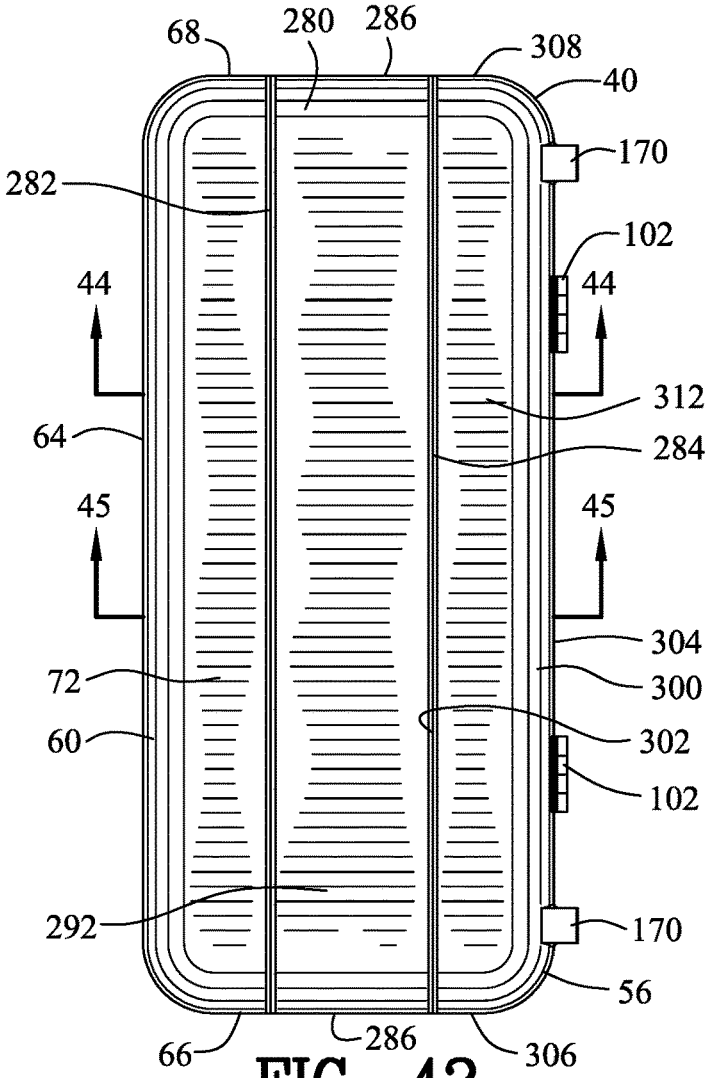
FIG. 42 is a top view of a third embodiment of the hinged closure engaging a container incorporating the present invention.
Figure 43:
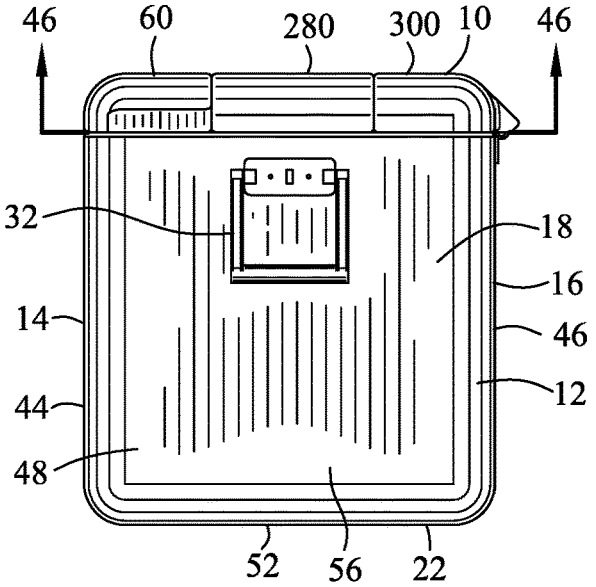
FIG. 43 is a right side view of FIG. 42.
Figure 46:
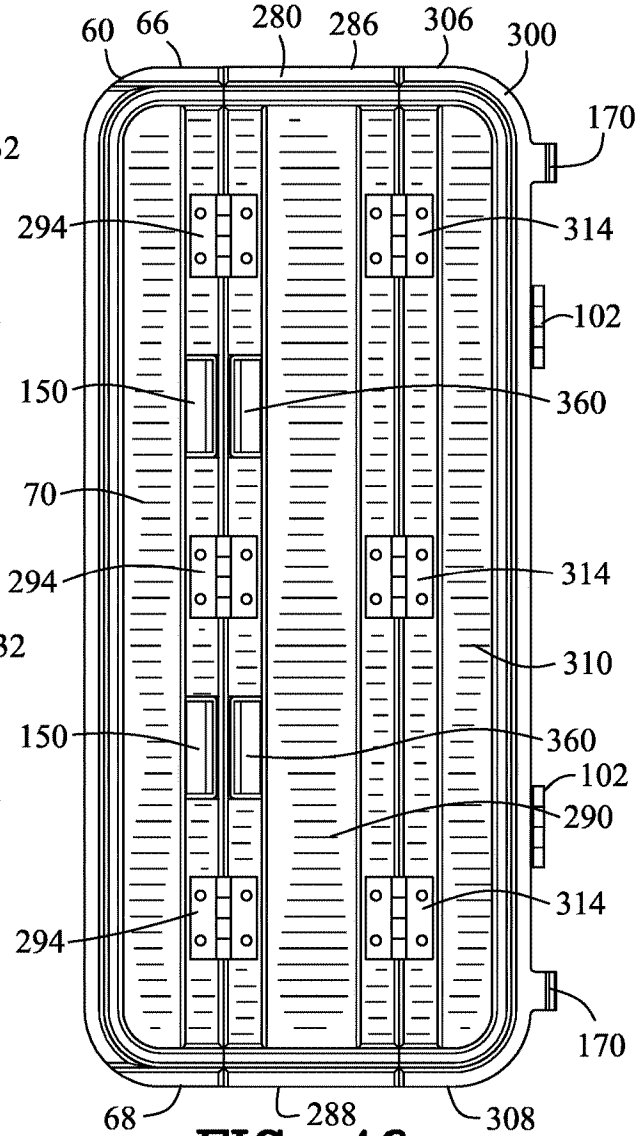
FIG. 46 is a sectional view along line 46-46 in FIG. 43.
Figure 44:
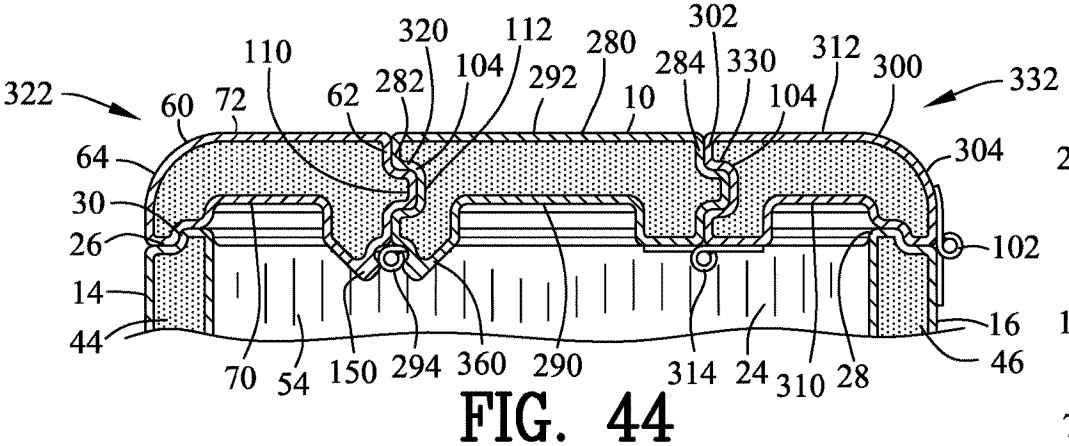
FIG. 44 is a sectional view along line 44-44 in FIG. 42.
Figure 45:
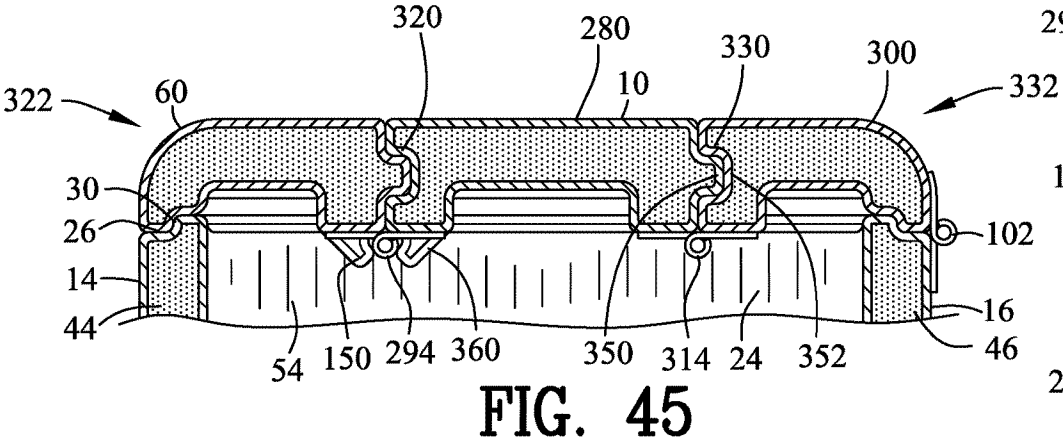
FIG. 45 is a sectional view along line 45-45 in FIG. 42.
Figure 47:
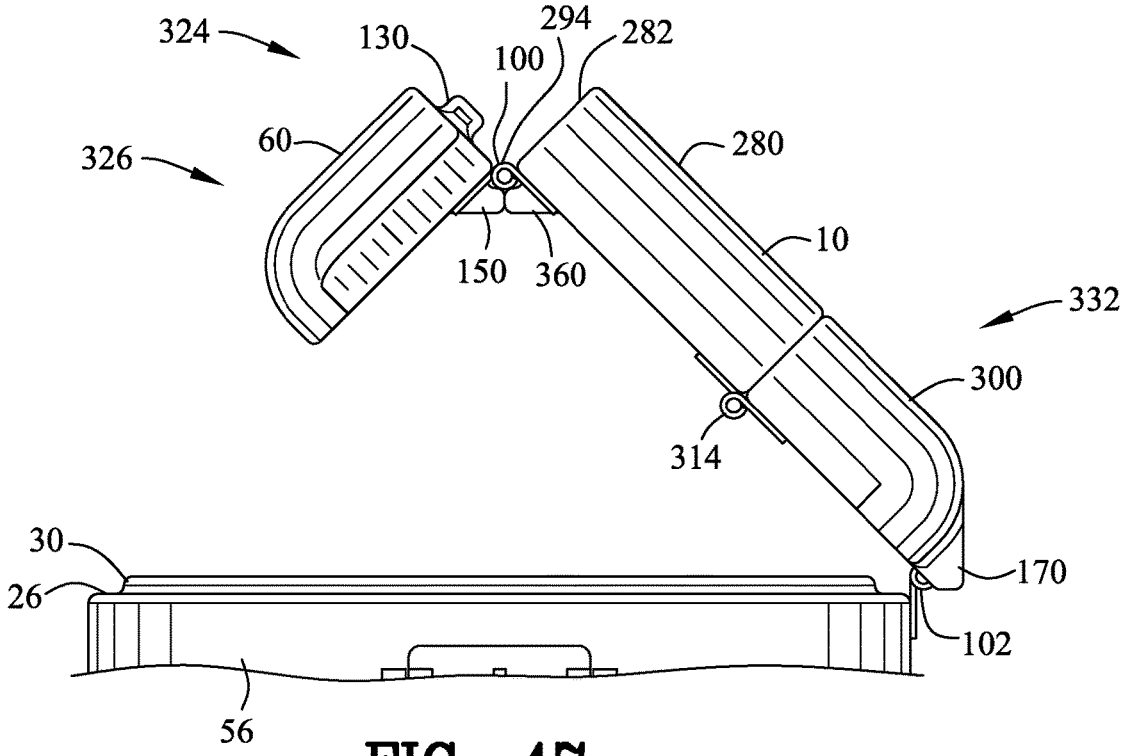
FIG. 47 is an enlarged portion of FIG. 43 illustrating a first closure pivoted relative a second closure and a first pivot stop abutting a second pivot stop for terminating pivoting of the first closure relative to the second closure.
Figure 48:
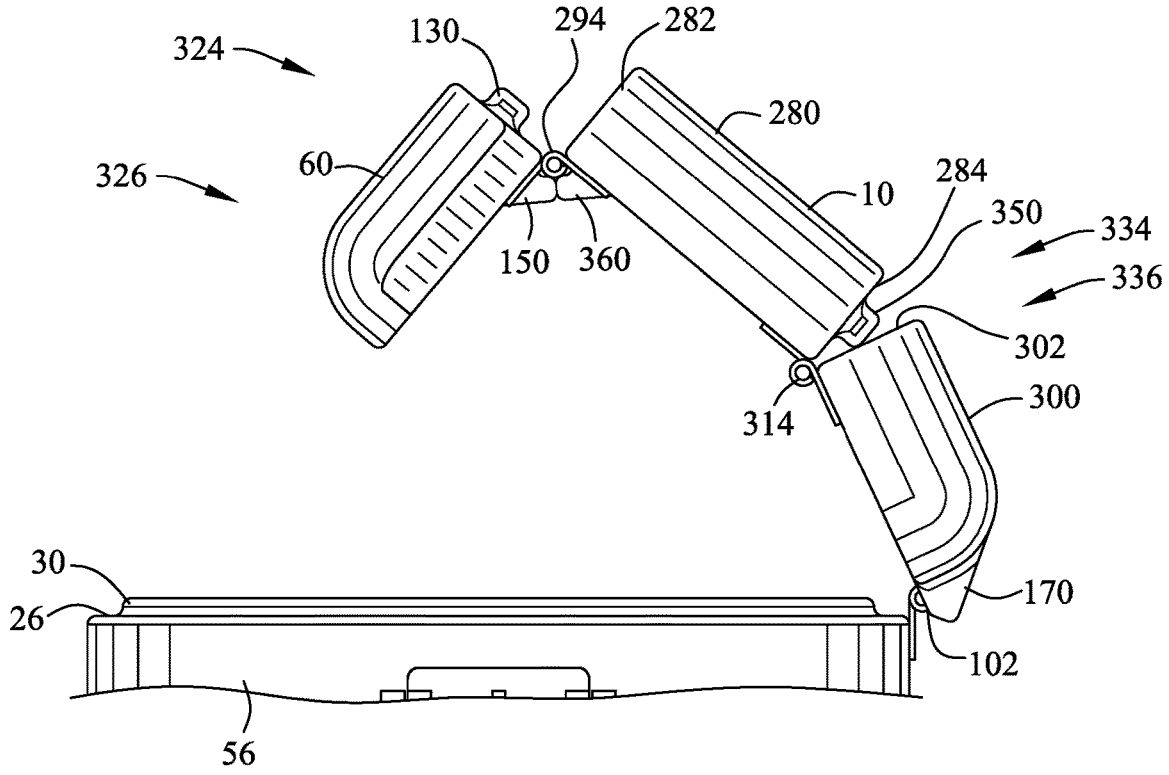
FIG. 48 is a view similar to FIG. 47 illustrating the second closure disengaging with a third closure for pivoting the second closure relative to the third closure.
Figure 49:
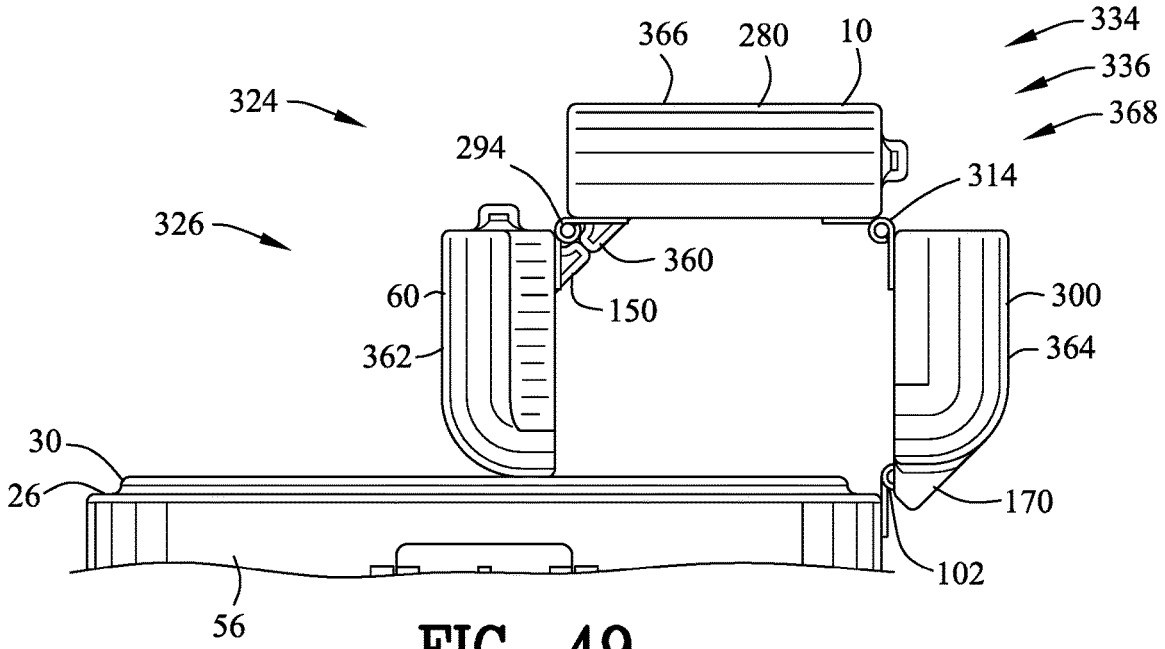
FIG. 49 is a view similar to FIG. 48 illustrating the first closure and the third closure including a vertical orientation and the second closure includes a horizontal orientation for defining a generally horizontal table surface on the second closure and permitting access into the container.

As best shown in FIGS. 35 and 3941, a second pivot stop channel 200 may be in the upper surface 92 of the second closure 80. A second actuator 202 is slidably engaged within the second pivot stop channel 200. The second actuator 202 is coupled to the second pivot stop 152 for displacing the second pivot stop 152 in the alignment orientation 158 with the first pivot stop 150 as shown in FIG. 40 for permitting abutting of the first pivot stop 150 with the second pivot stop 152 and a non-alignment orientation 159 with the first pivot stop 150 as shown in FIG. 39 and avoiding abutting of the first pivot stop 150 with the second pivot stop 152. By utilizing the second actuator 202 within the second pivot stop channel 200 in the upper surface 92 of the second closure 80, permits the displacement of the second pivot stop 152 from the outside of the hinged closure 10.

Figure 38:
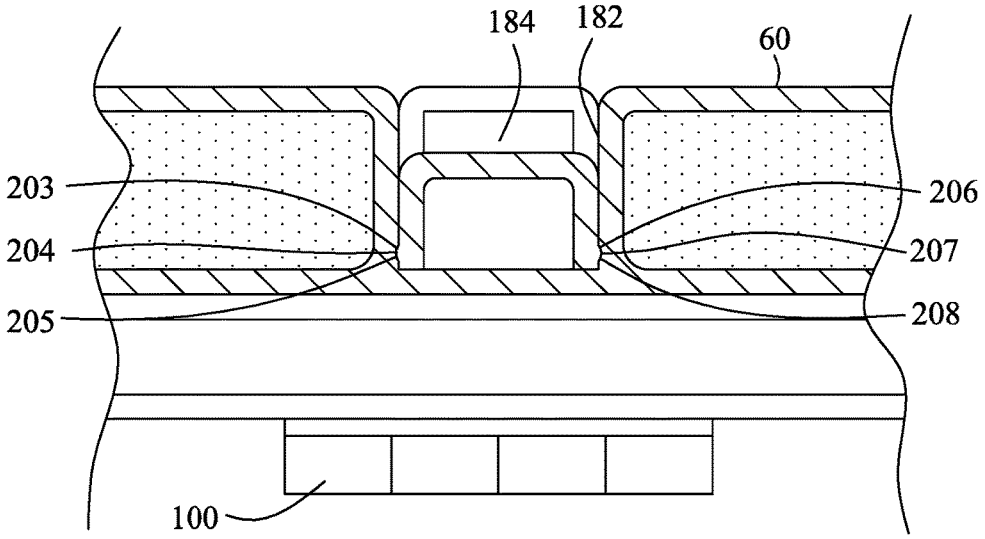
FIG. 38 is a sectional view along line 38-38 in FIG. 35.

As shown in FIG. 38, the second actuator 202 may be secured within the second pivot stop channel 200 by a primary sliding engagement 203 including a primary male rib 204 and a primary female rib 205 and a secondary sliding engagement 206 including a secondary male rib 207 and a secondary female rib 208. The second actuator 202 would be compressed for positioning the second actuator to have to within the second pivot stop chamber 200. The second actuator 202 would be depressed within the second pivot stop chamber 200 until the engagement between the primary male rib 204 and the primary female rib 205 and the engagement between the secondary male rib 207 and the secondary female rib 208.

The hinged closure 10 may further a closure leg 210 pivotably coupled to the first closure 60. The closure leg 210 may be positioned into a generally vertical orientation 212 and engaging the container as shown in FIGS. 21-24, 52 and 53 for supporting the linear closure 120 in a partially opened position 214 and permitting access into the container 12 and defining a second reduced closure height 216 relative to the container 12.

Figure 4:
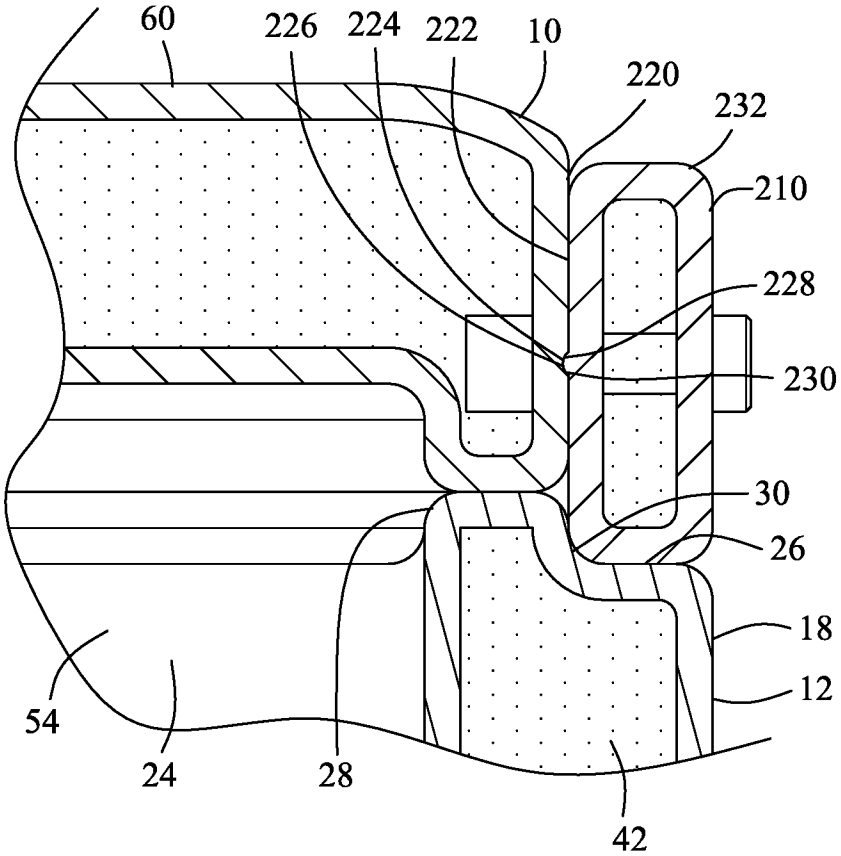
FIG. 4 is a sectional view along line 4-4 in FIG. 1.
Figure 3:
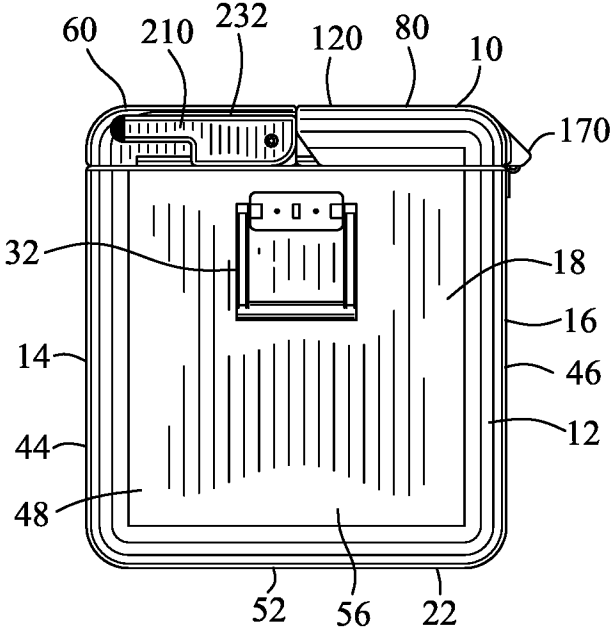
FIG. 3 is a right side view of FIG. 2.
Figure 5:
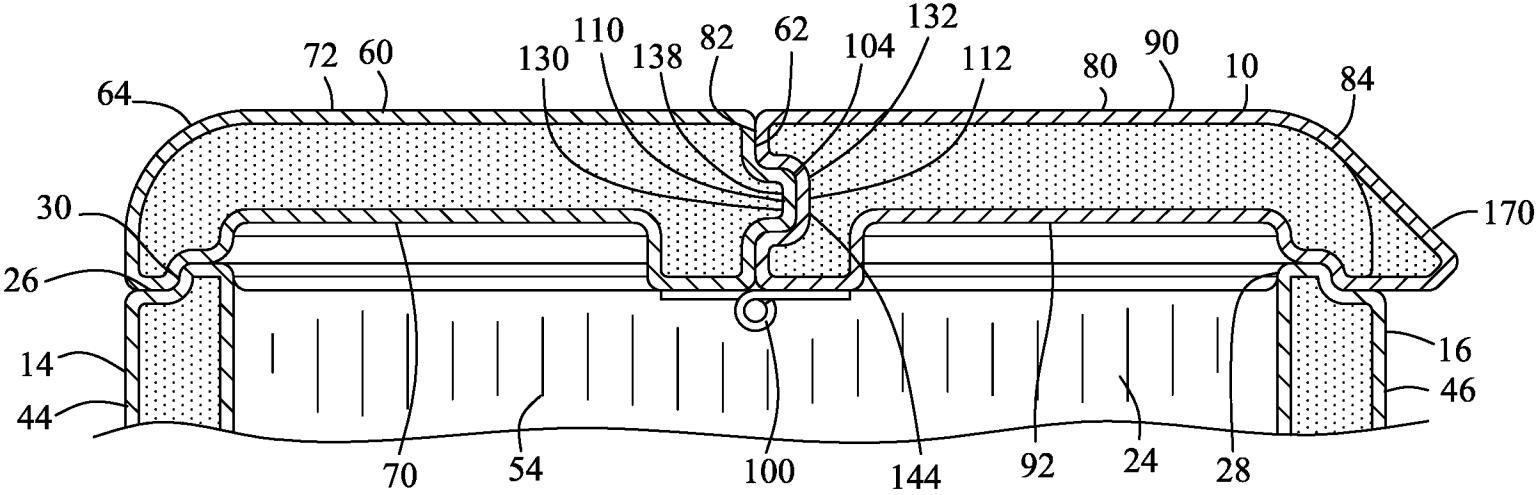
FIG. 5 is a sectional view along line 5-5 in FIG. 1.
Figure 6:
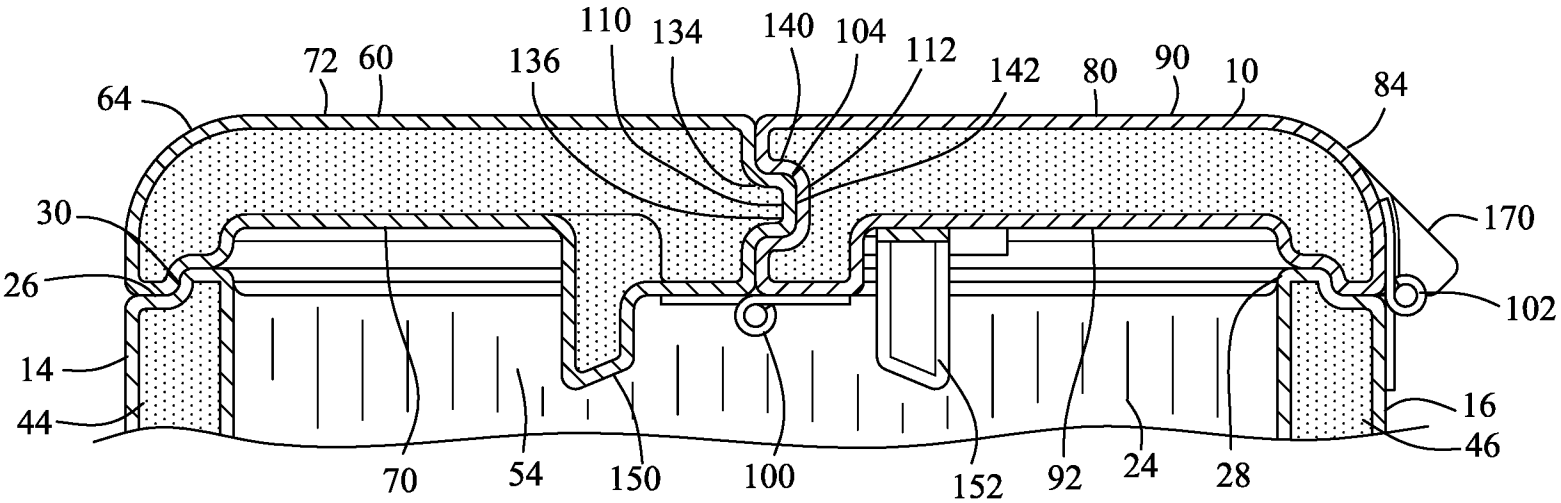
FIG. 6 is a sectional view along line 6-6 in FIG. 1.
Figures 7, 8, 9, 10, 11, 12:
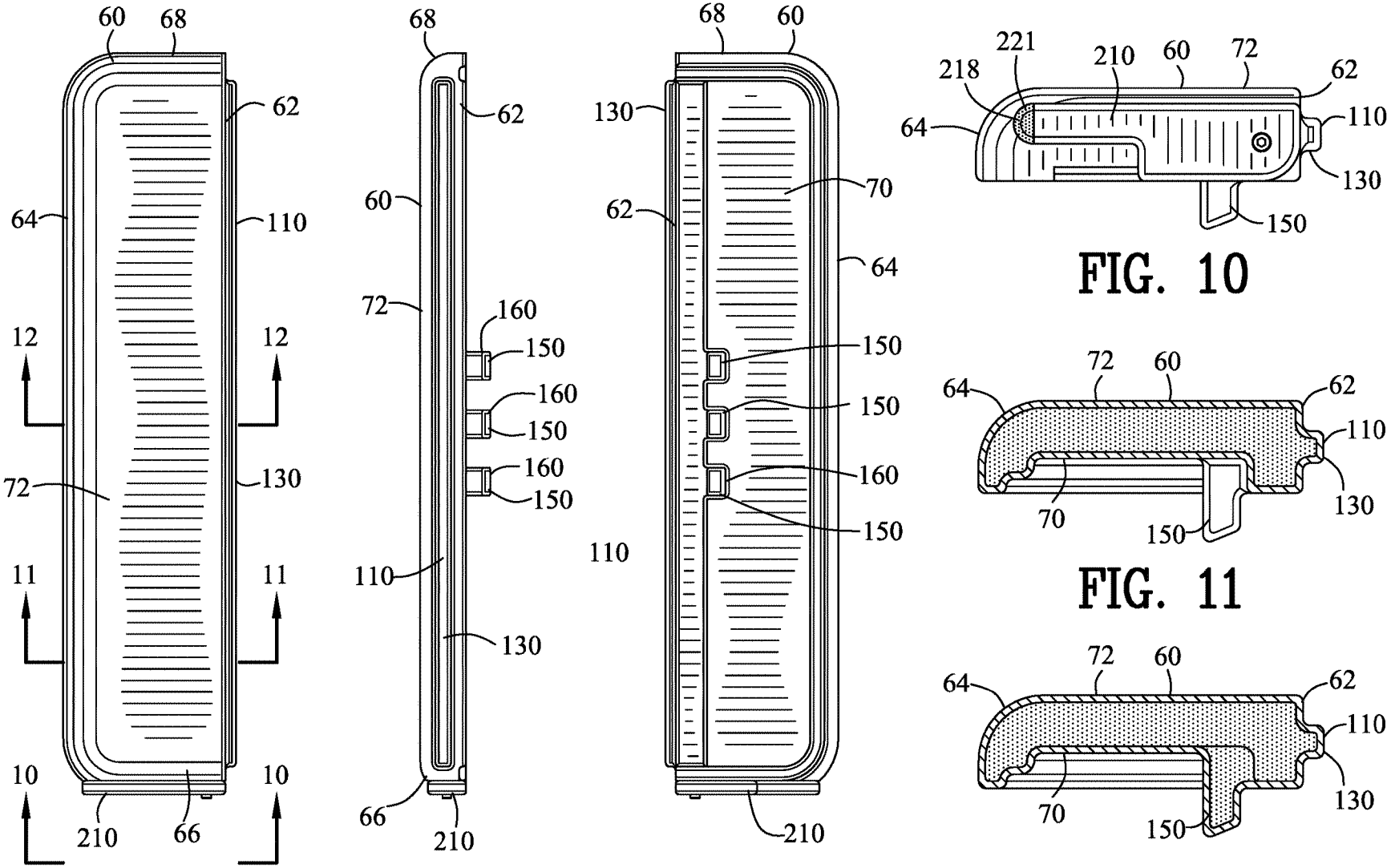
FIG. 7 is a top view of a first closure in FIG. 1.
FIG. 8 is a right side view of FIG. 7.
FIG. 9 is a bottom view of FIG. 7.
FIG. 10 is a view along line 10-10 in FIG. 7.
FIG. 11 is a sectional view along line 11-11 in FIG. 7.
FIG. 12 is a sectional view along line 12-12 in FIG. 7.
Figures 13, 14, 15, 16, 17, 18:
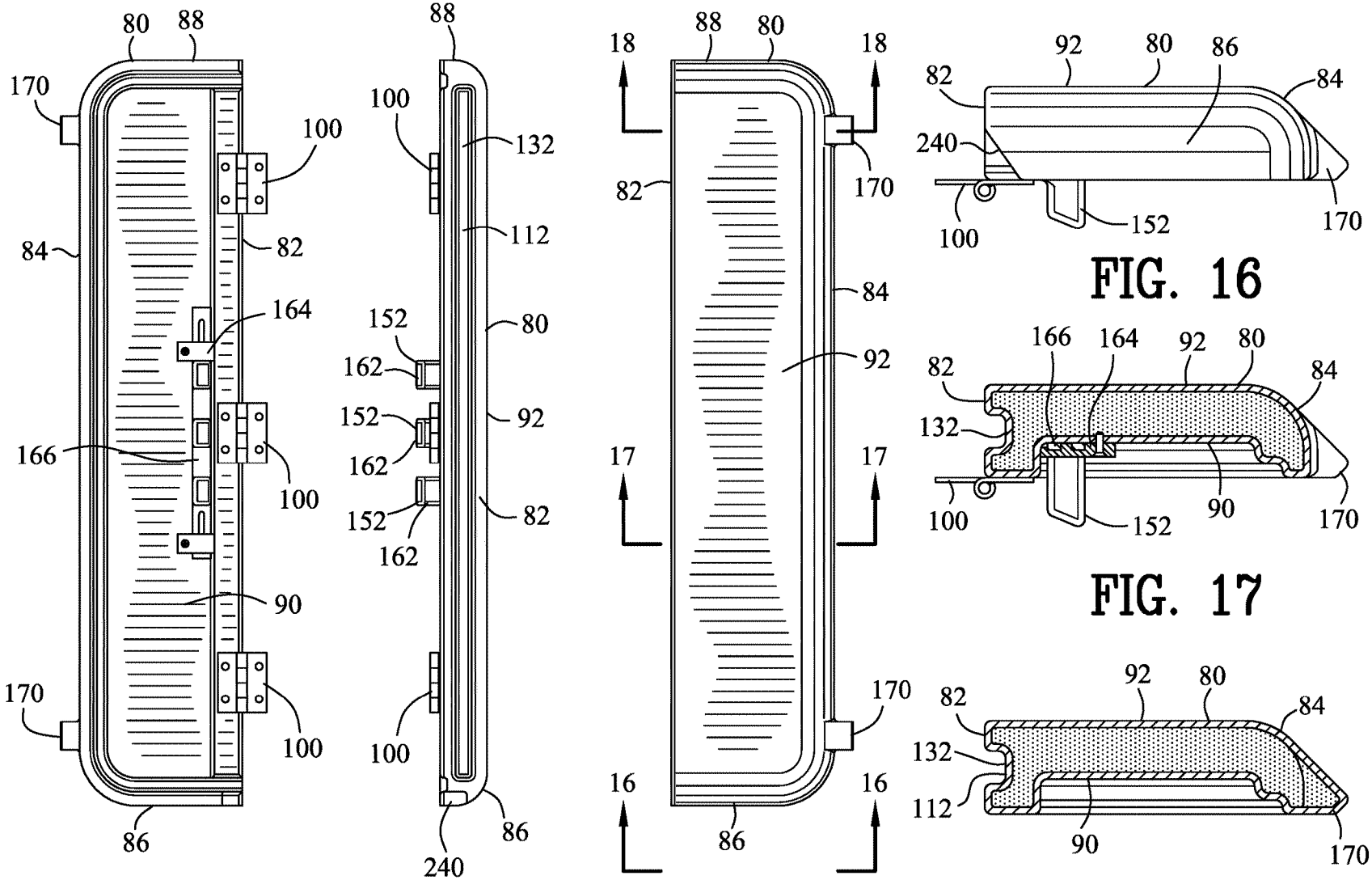
FIG. 13 is a top view of a second closure in FIG. 1.
FIG. 14 is a left side view of FIG. 13.
FIG. 15 is a bottom view of FIG. 13.
FIG. 16 is a view along line 16-16 in FIG. 13.
FIG. 17 is a sectional view along line 17-17 in FIG. 13.
FIG. 18 is a sectional view along line 18-18 in FIG. 13.
Figure 19:
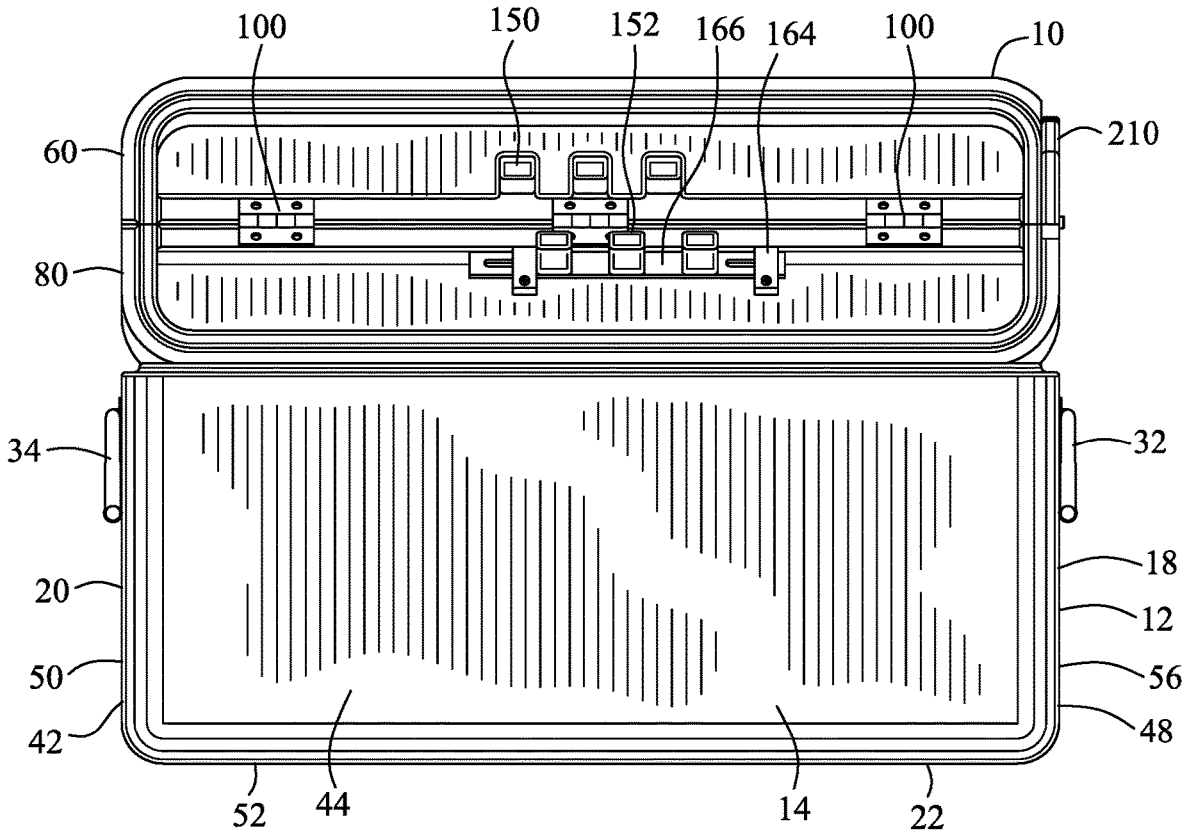
FIG. 19 is a view similar to FIG. 2 illustrating the hinged closure pivotably displaced from the container and a closure stop abutting the container.
Figure 20:
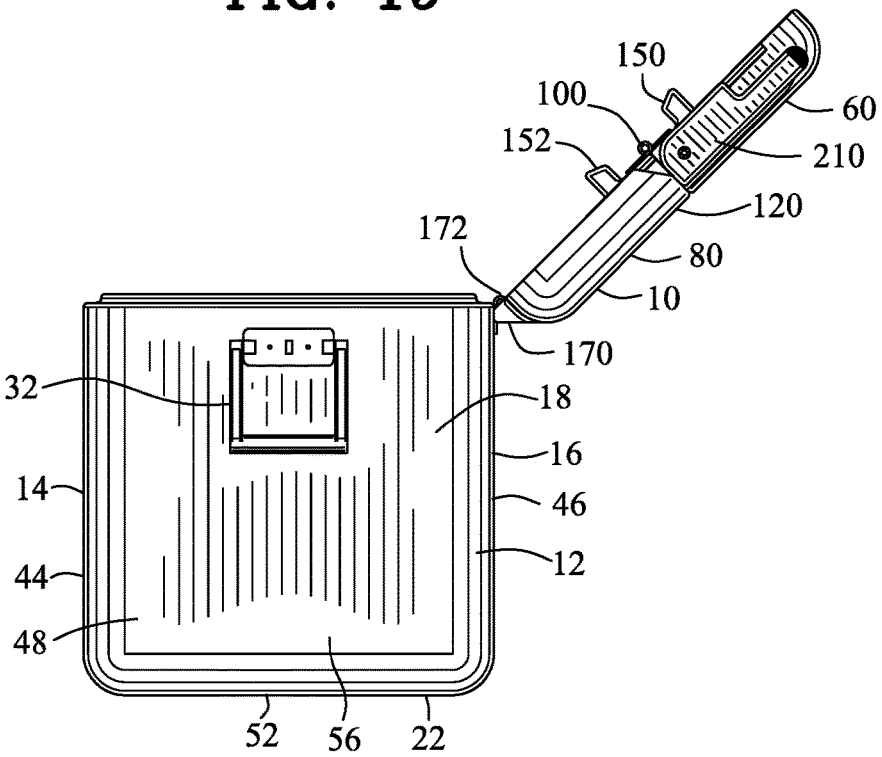
FIG. 20 is a right side view of FIG. 19 illustrating the closure stop abutting the container for terminating pivoting of the hinge closure relative to the container.
Figure 22:
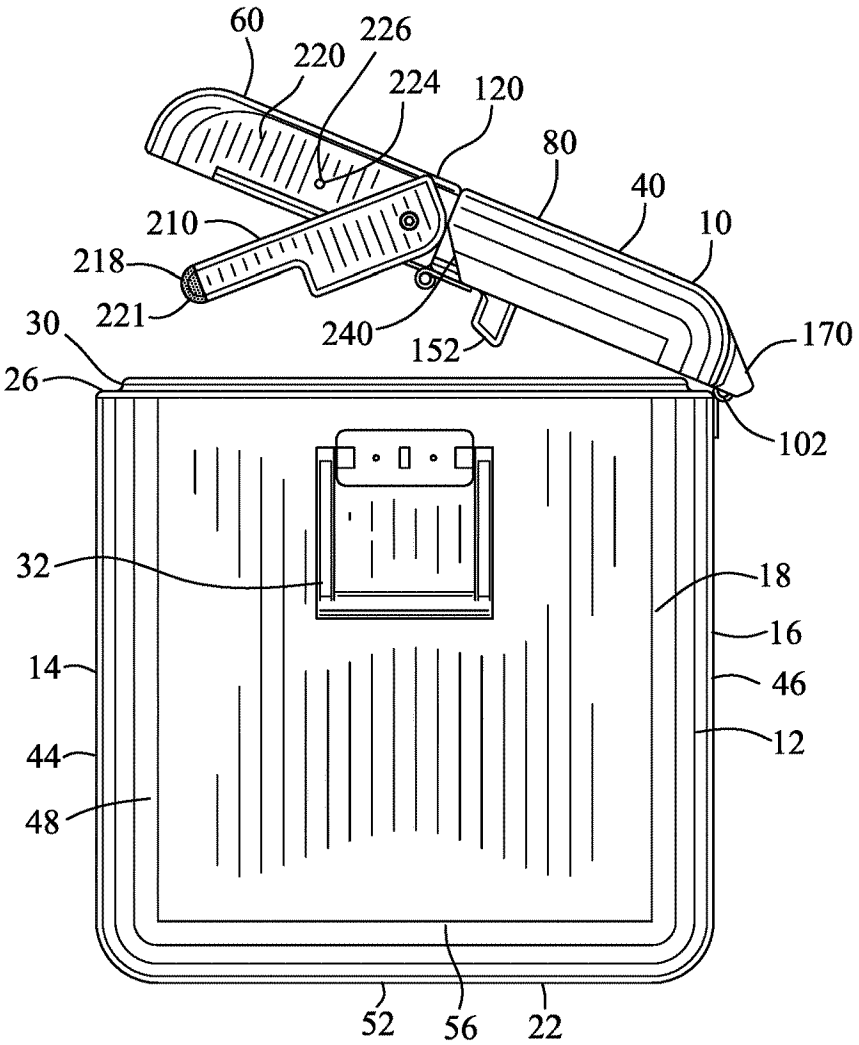
FIG. 22 is a view similar to FIG. 21 wherein a closure leg is pivotably displaced from the hinged closure.
Figure 21:
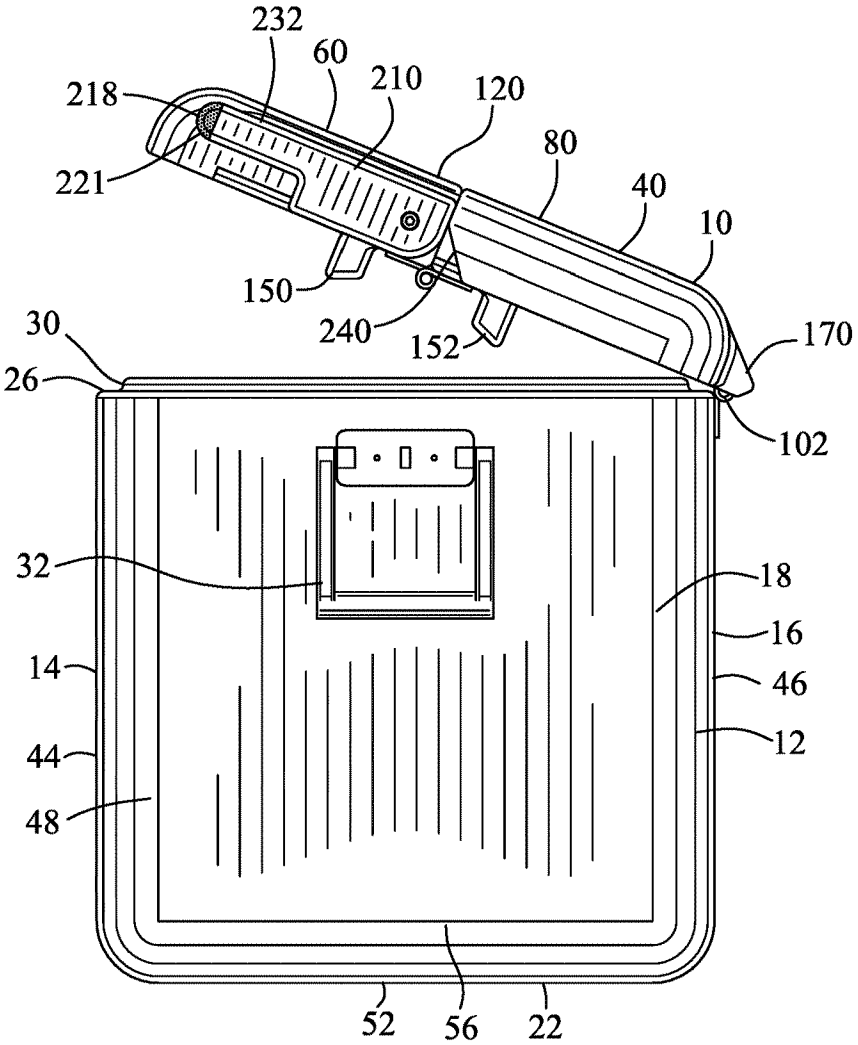
FIG. 21 is a view similar to FIG. 3 illustrating the hinged closure partially pivoted from the container.

FIGS. 1-4 and 21-24, 52 and 53 illustrate a leg channel 220 in the first side 66 of the first closure 60. The closure leg 210 is positioned within the leg channel 220 for defining a linear side surface 222 with the closure leg 210 and the first side 66 of the first closure 60. FIG. 4 illustrates a first leg retainer 224 coupled to the first closure 60. More specifically, the first leg retainer 224 may include a recessed portion 226. The closure leg 210 may include a second leg retainer 228. More specifically, the second leg retainer 228 may include a raised portion 230. The first leg retainer 224 engages the second leg retainer 228 for maintaining the closure leg 210 in a parallel orientation 323 with the first closure 60 for permitting the first closure 60 and the second closure 80 to fully engage with the container 12 in the linear closure 120 within the first closure 60 and the second closure 80.

Figure 53:
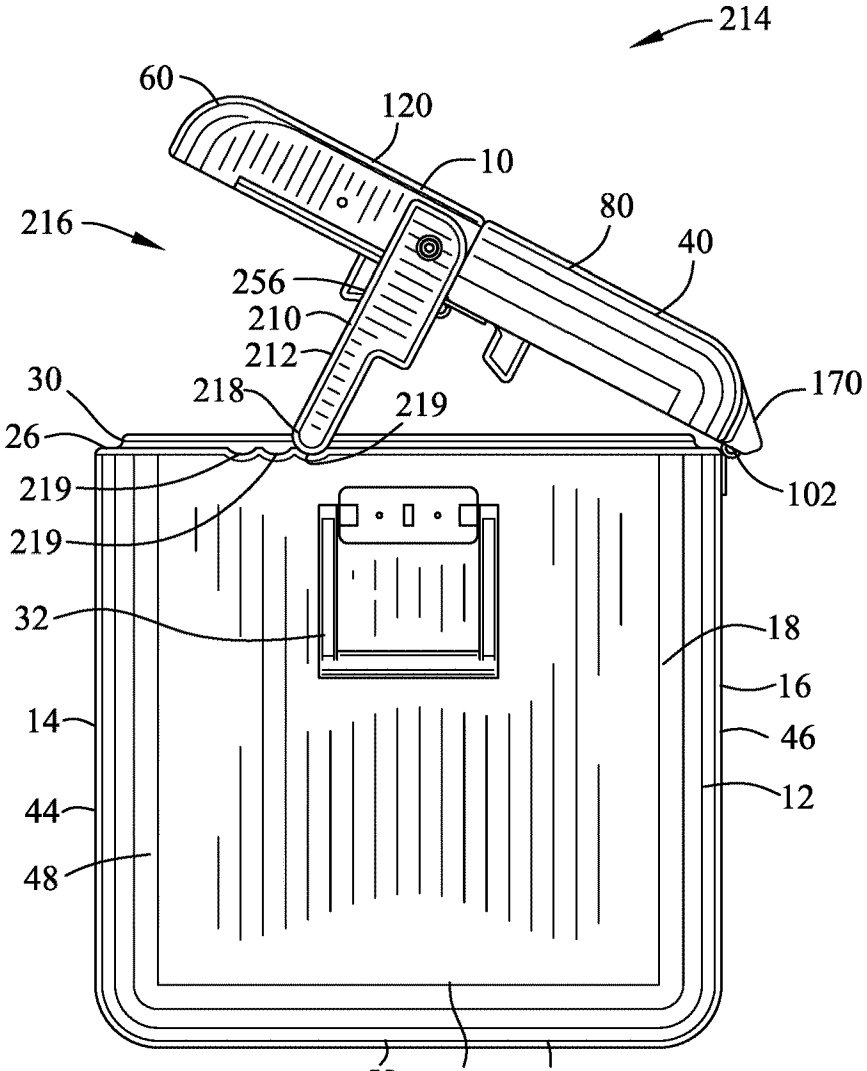
FIG. 53 is a right side view of FIG. 50 illustrating the closure leg being pivotably displaced from the hinged closure and engaging the container in a partially opened position and permitting access into the container.
Figure 52:
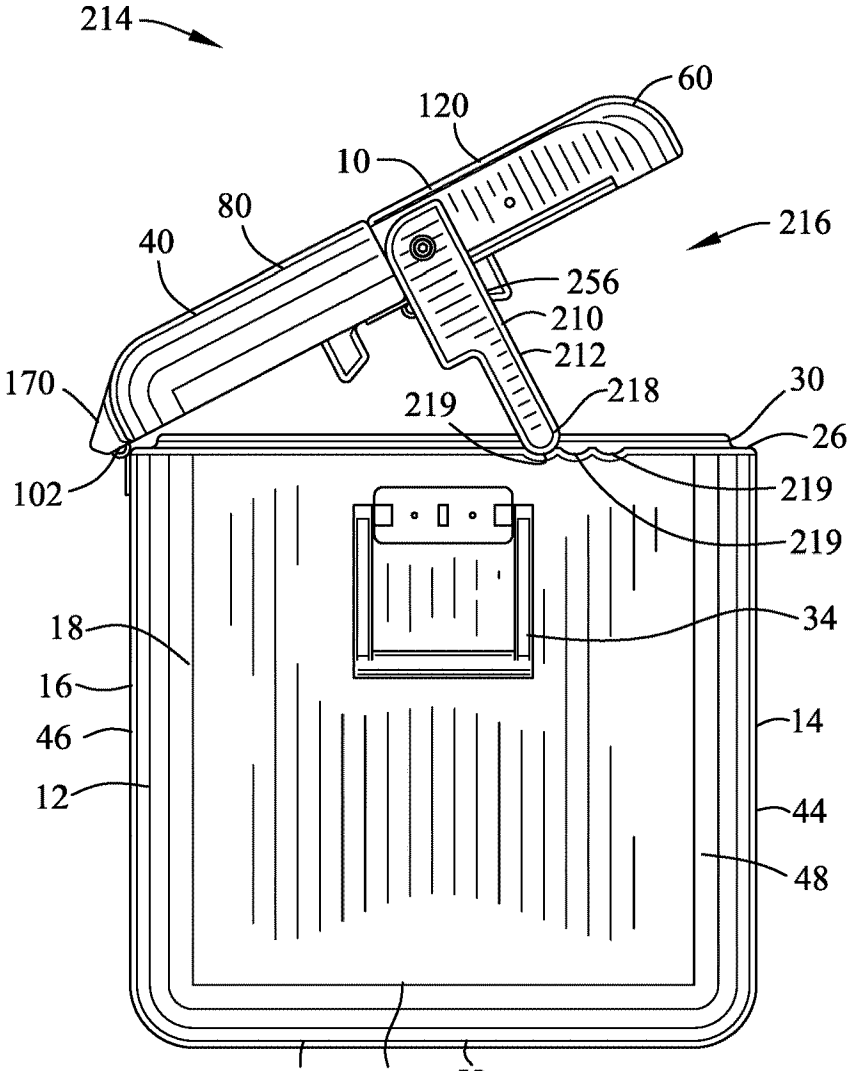
FIG. 52 is a left side view of FIG. 50 illustrating the second closure leg being pivotably displaced from the hinged closure and engaging the container in a partially opened position and permitting access into the container.
Figure 54:
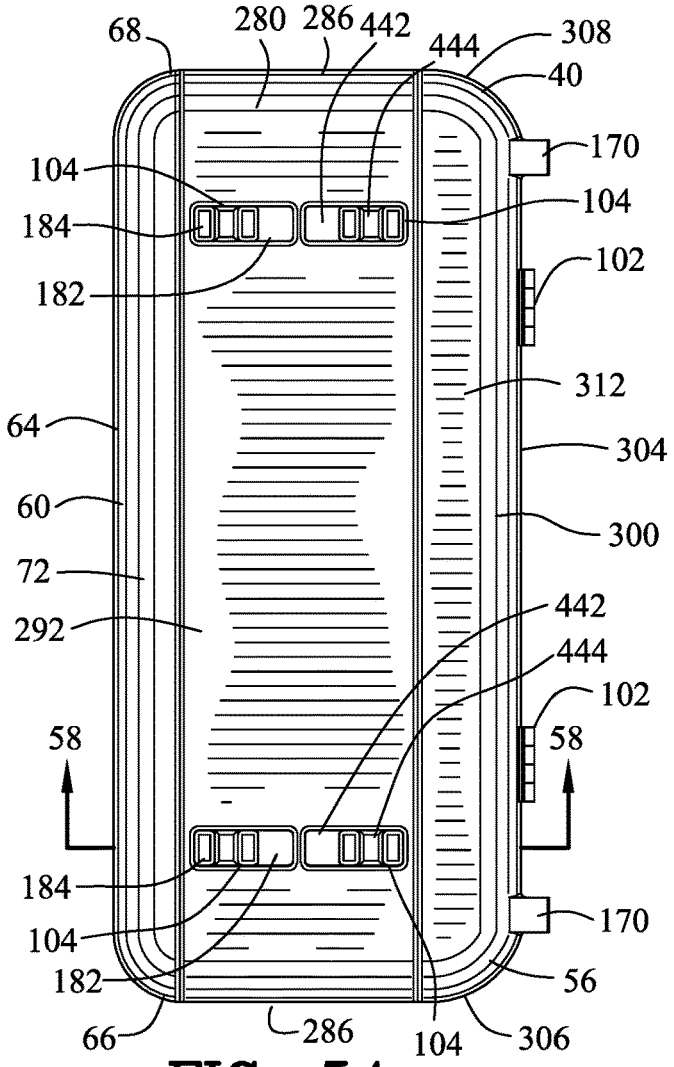
FIG. 54 is a top view of a fifth embodiment of the hinged closure engaging a container incorporating the present invention.
Figure 55:
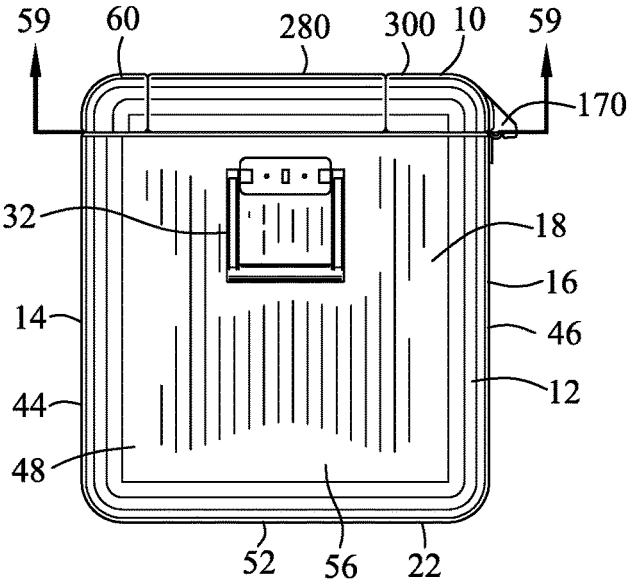
FIG. 55 is a right side view of FIG. 54.
Figures 56, 57:
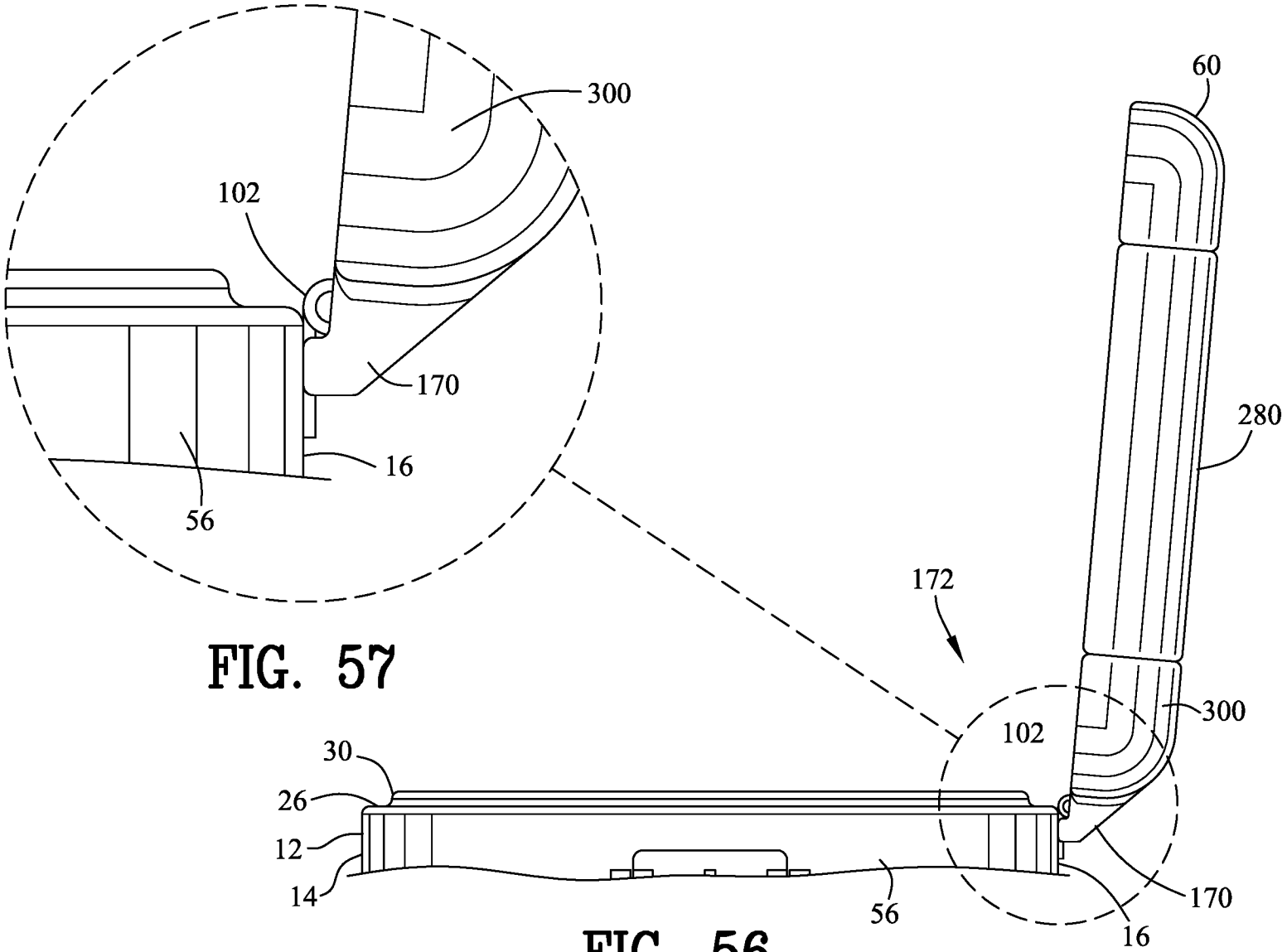
FIG. 56 is an enlarged portion of FIG. 55 illustrating the closure stop abutting the container for terminating pivoting of the hinged closure relative to the container.
FIG. 57 is an enlarged portion of FIG. 56.
Figure 59:
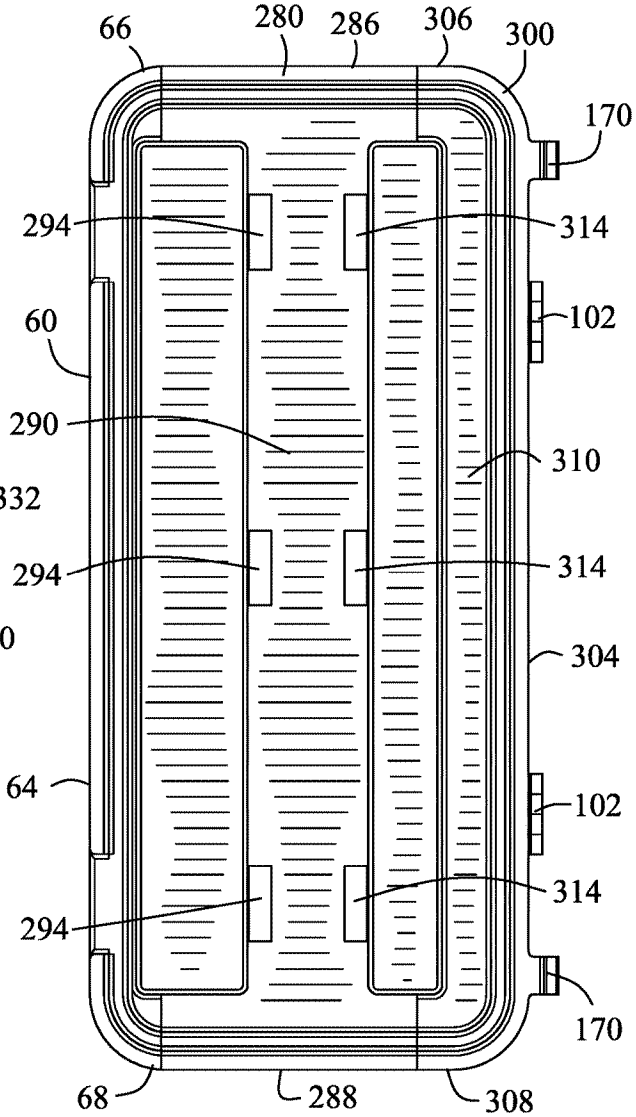
FIG. 59 is a sectional view along line 59-59 in FIG. 55.
Figure 58:
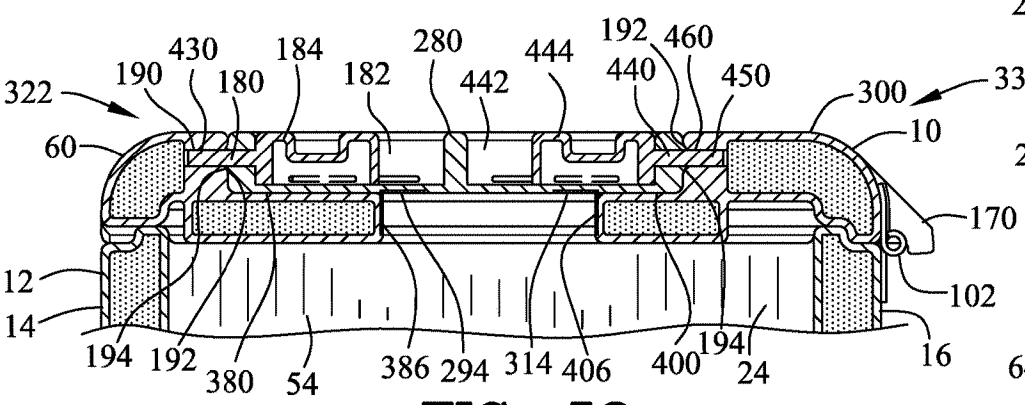
FIG. 58 is a sectional view along line 58-58 in FIG. 54.
Figure 60:
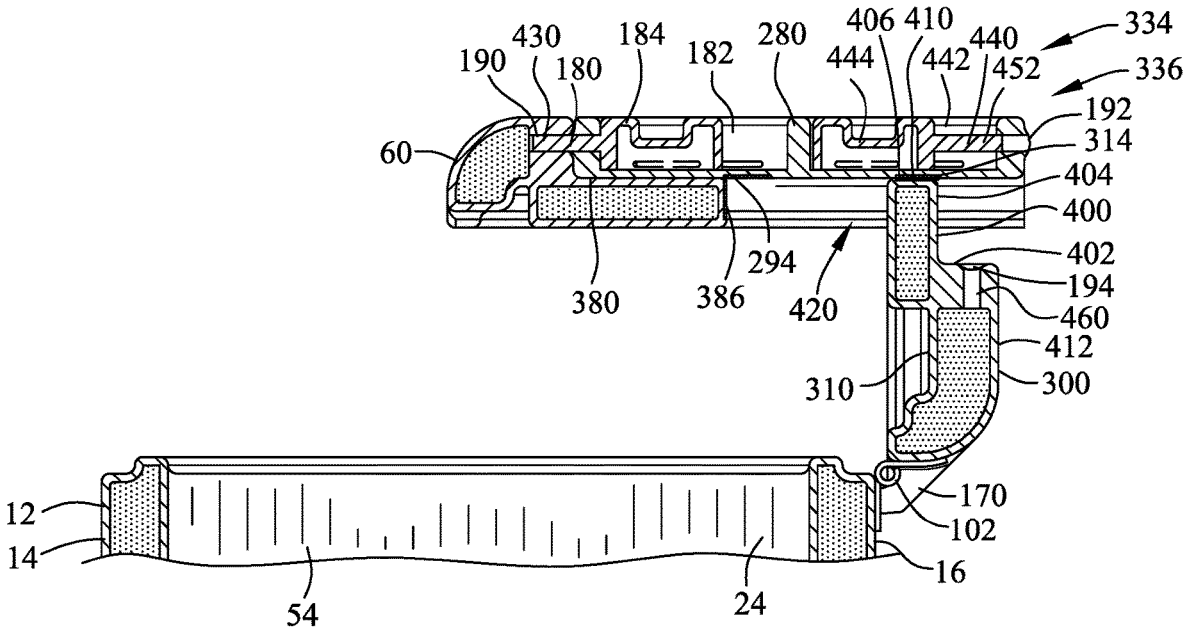
FIG. 60 is a view similar to FIG. 58 illustrating a third locking pin being removed from the third closure for permitting pivoting of the second closure relative to the third closure.
Figure 61:
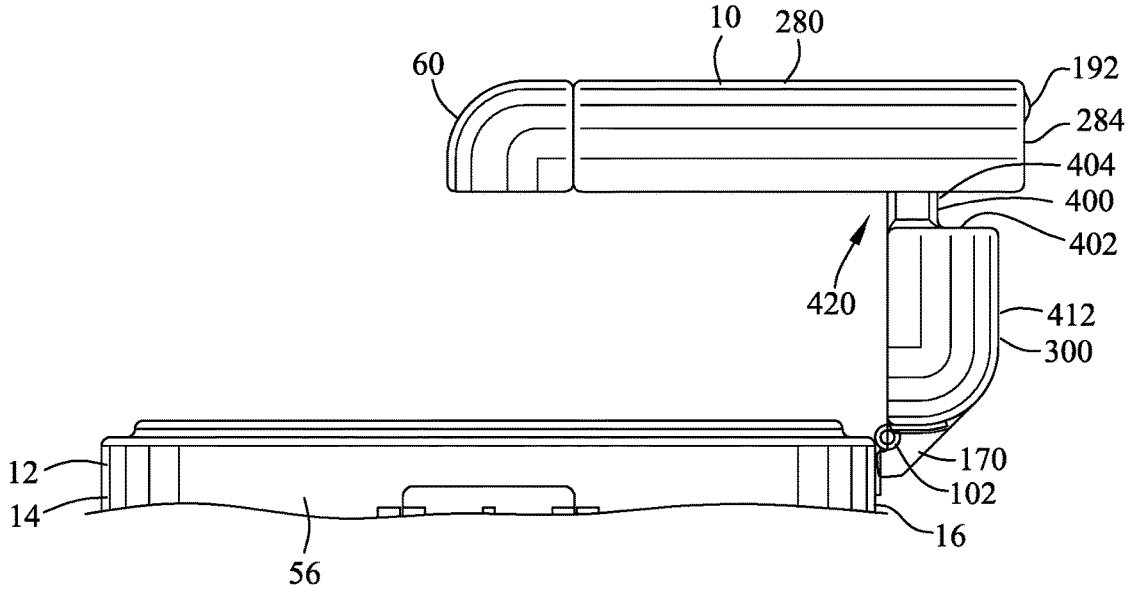
FIG. 61 is a side view of FIG. 60.
Figure 62:
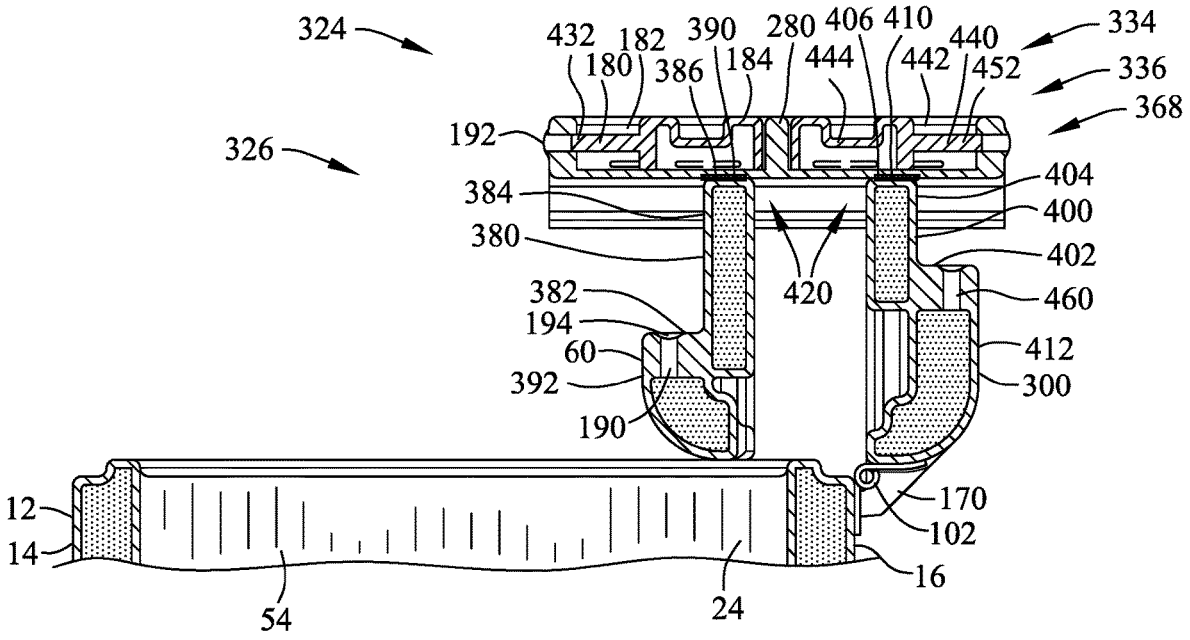
FIG. 62 is a view similar to FIG. 60 illustrating a first locking pin being removed from the second closure for permitting pivoting of the first closure relative to the second closure.

As best shown in FIGS. 1-4, the leg channel 220 receives the closure leg 210 such that the overall exterior of the hinged closure 10 along with the first sidewall 18 of the container 12 is substantially linear without any substantially protruding components. The closure leg 210 may further include a substantially spherical end 218 for engaging the upper ledge 26. The substantially spherical end 218 may be coated with a non-skid surface 221 for preventing slippage of the closure leg 210 along the upper ledge 26. As shown in FIGS. 52 and 53, the upper ledge 26 may include a plurality of spherical pockets 219 for receiving the substantially spherical end 218. The user may select one of the plurality of spherical pockets 219 depending upon the elevation that of the hinge closure 10 relative to the container 12. Furthermore, the plurality of spherical pockets 219 prevent slippage of the closure leg 210 along the upper ledge 26.

Figure 24:
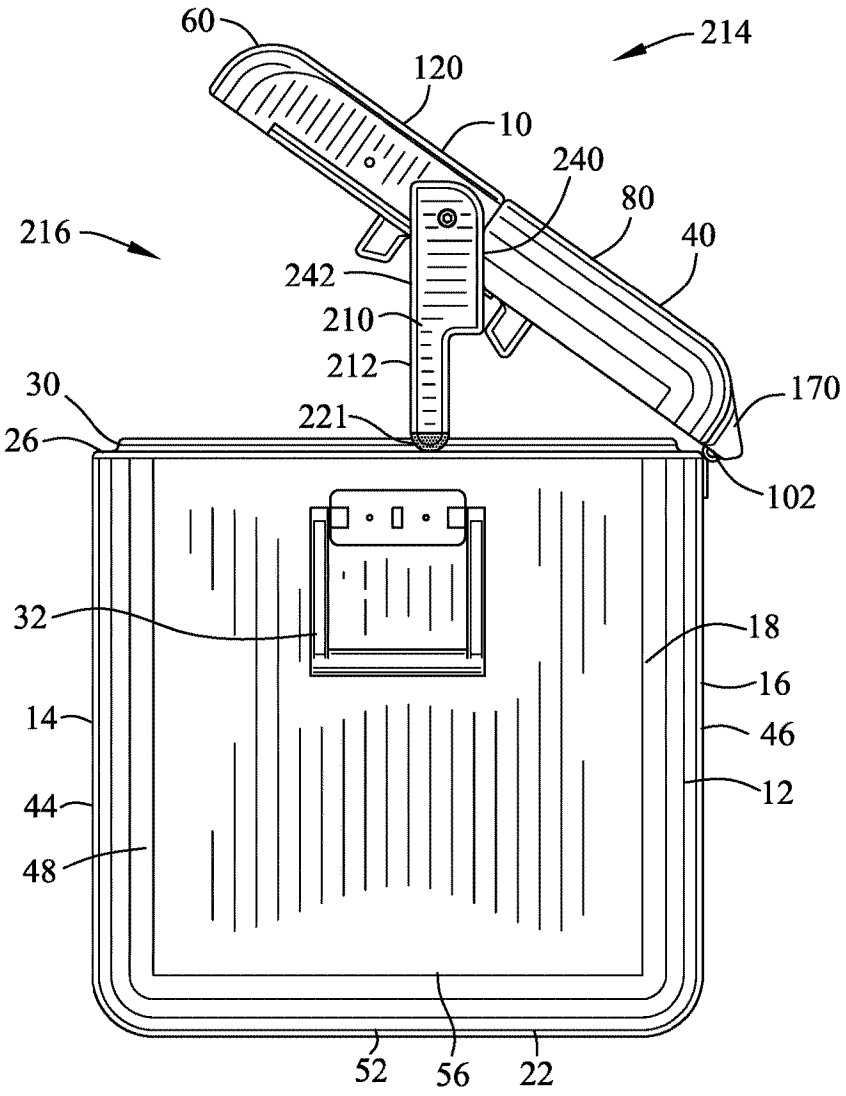
FIG. 24 is a view similar to FIG. 23 wherein the closure leg is further pivoted relative to the hinged closure and the closure leg is abutting a leg stop surface in the second closure for supporting the closure in an increased partially opened position.
Figure 23:
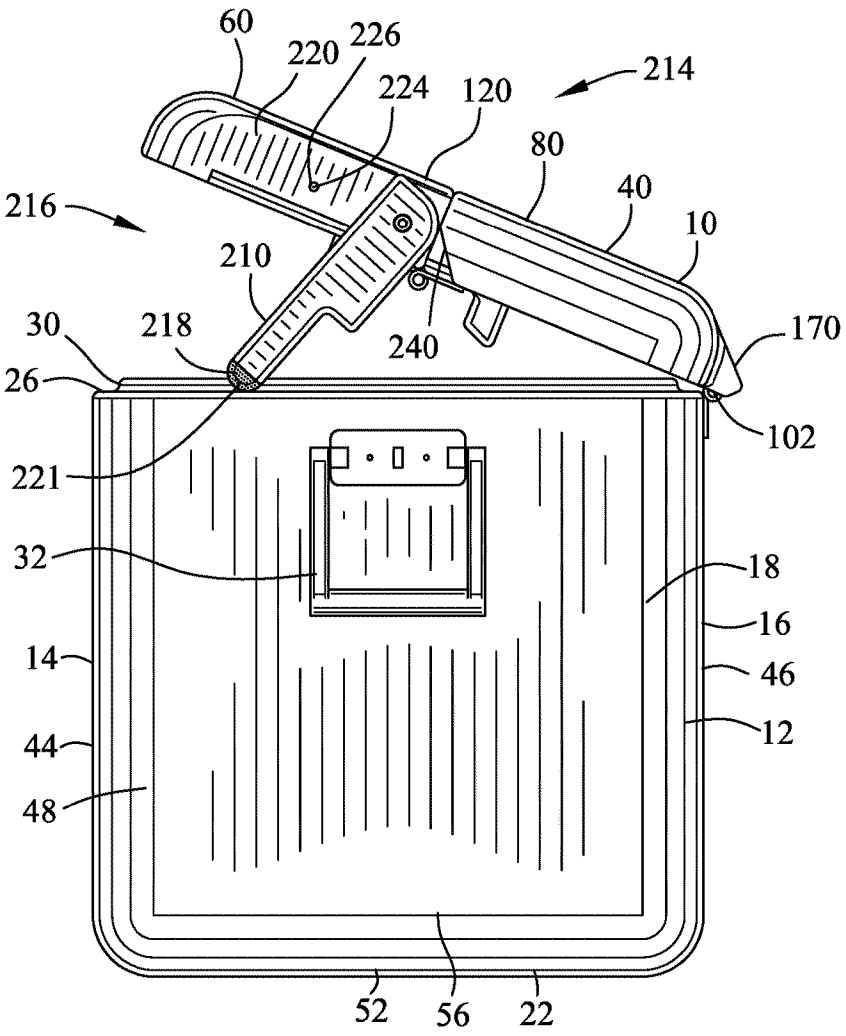
FIG. 23 is a view similar to FIG. 22 wherein the closure leg is further pivoted relative to the hinged closure and the closure leg is abutting the closure for supporting the closure in a partially opened position and permitting access into the container.
Figure 26:
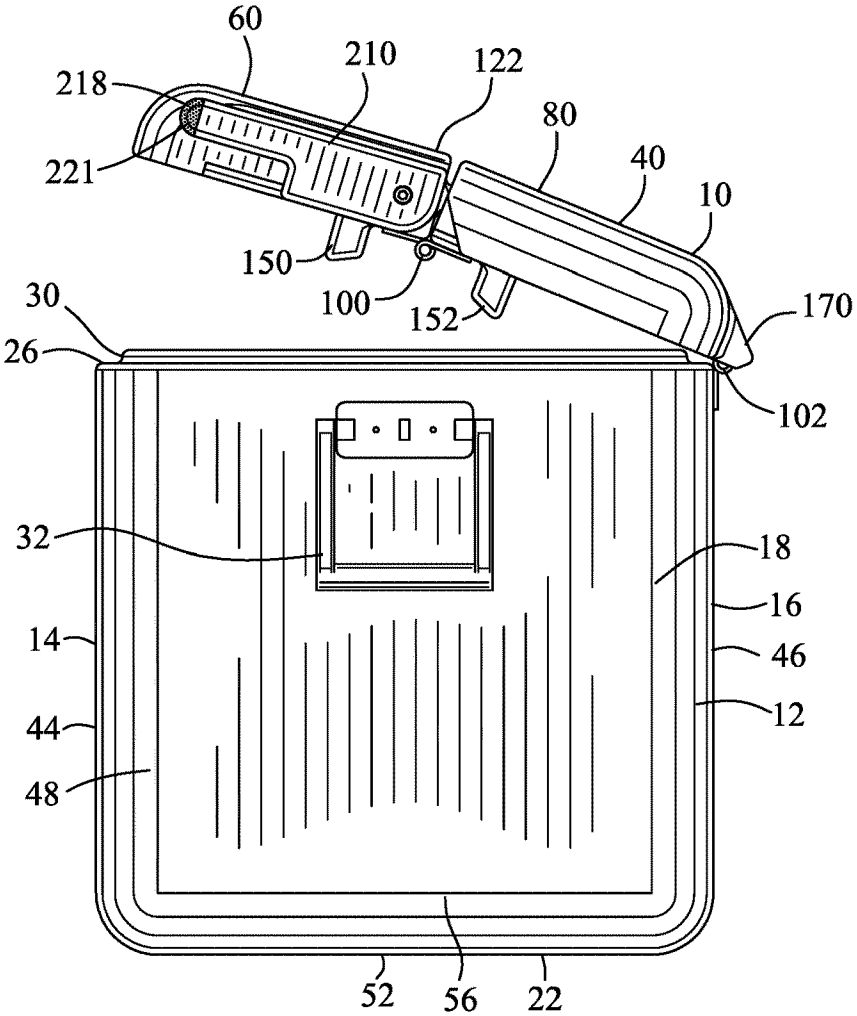
FIG. 26 is a view similar to FIG. 25 illustrating the first closure and the second closure being pivoted for defining a non linear orientation or nonlinear closure within the first closure and the second closure.
Figure 25:
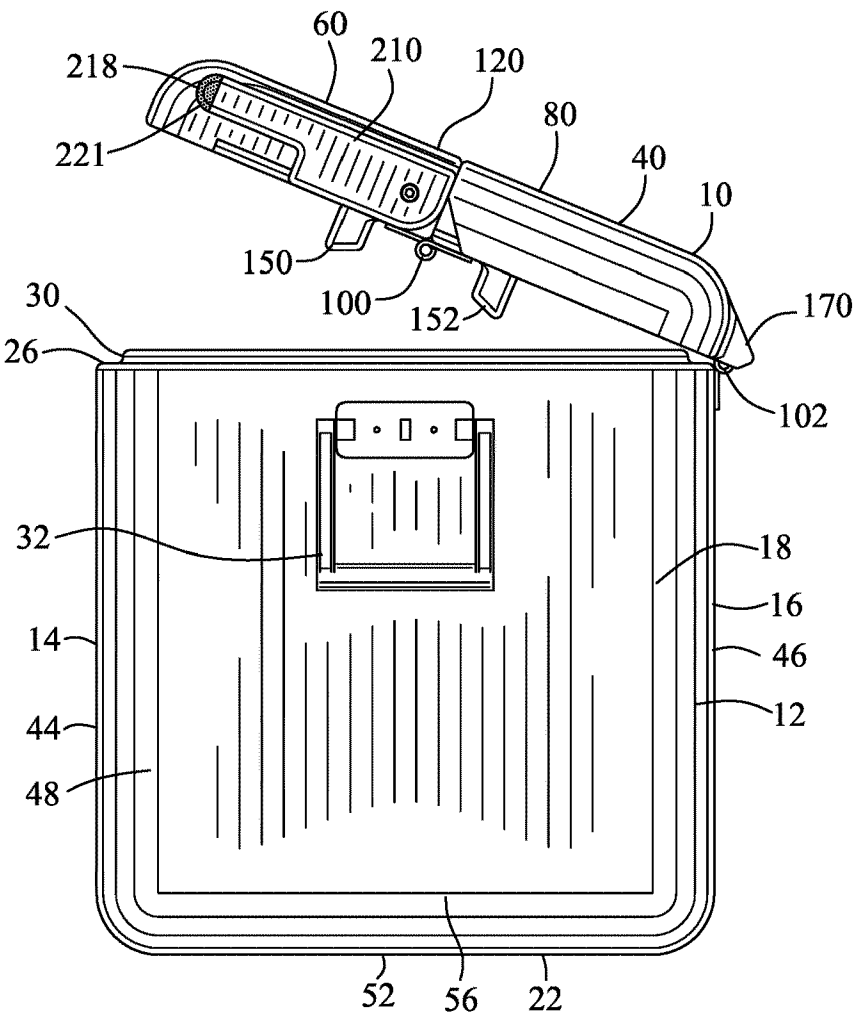
FIG. 25 is a view similar to FIG. 21 illustrating the first closure and the second closure including a linear orientation or linear closure within the first closure and the second closure.
Figure 28:
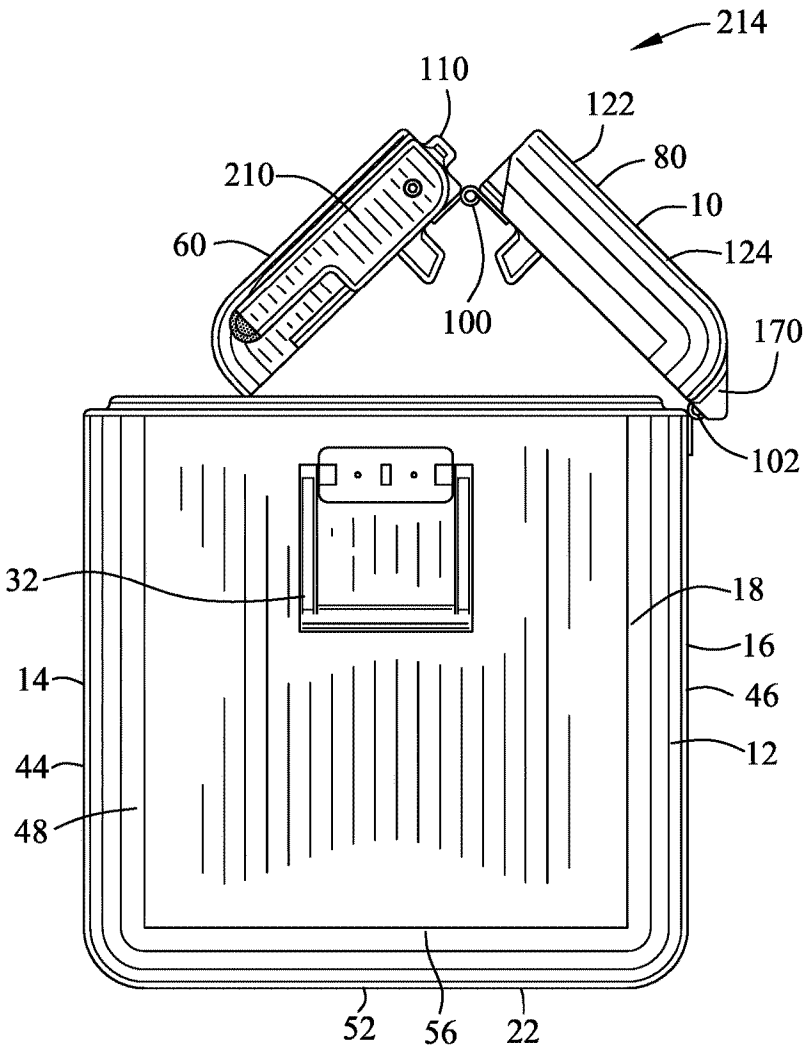
FIG. 28 is a view similar to FIG. 26 illustrating the first closure and the second closure including a further non linear orientation in the hinged closure and the first closure is abutting the closure for supporting the hinged closure in a partially opened position and permitting access into the container.
Figure 27:
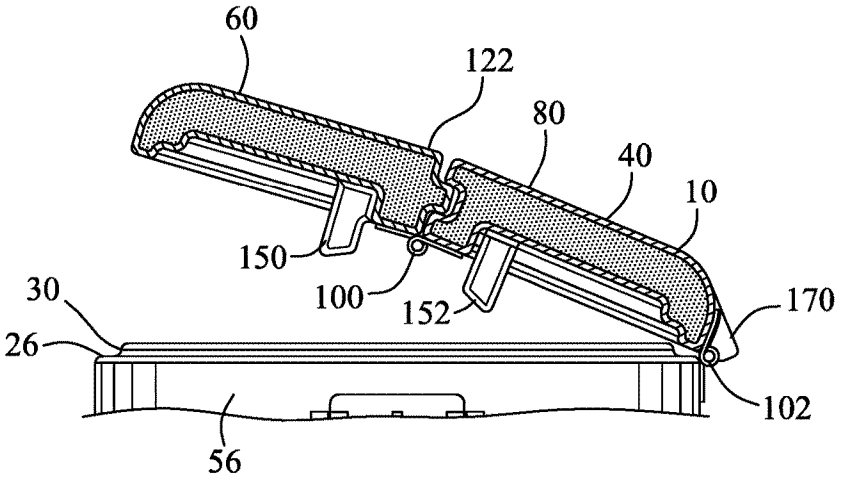
FIG. 27 is a sectional view of closure of FIG. 26 illustrating a first male body being removed from a second female channel for pivoting the first closure relative to the second closure.
Figure 29:
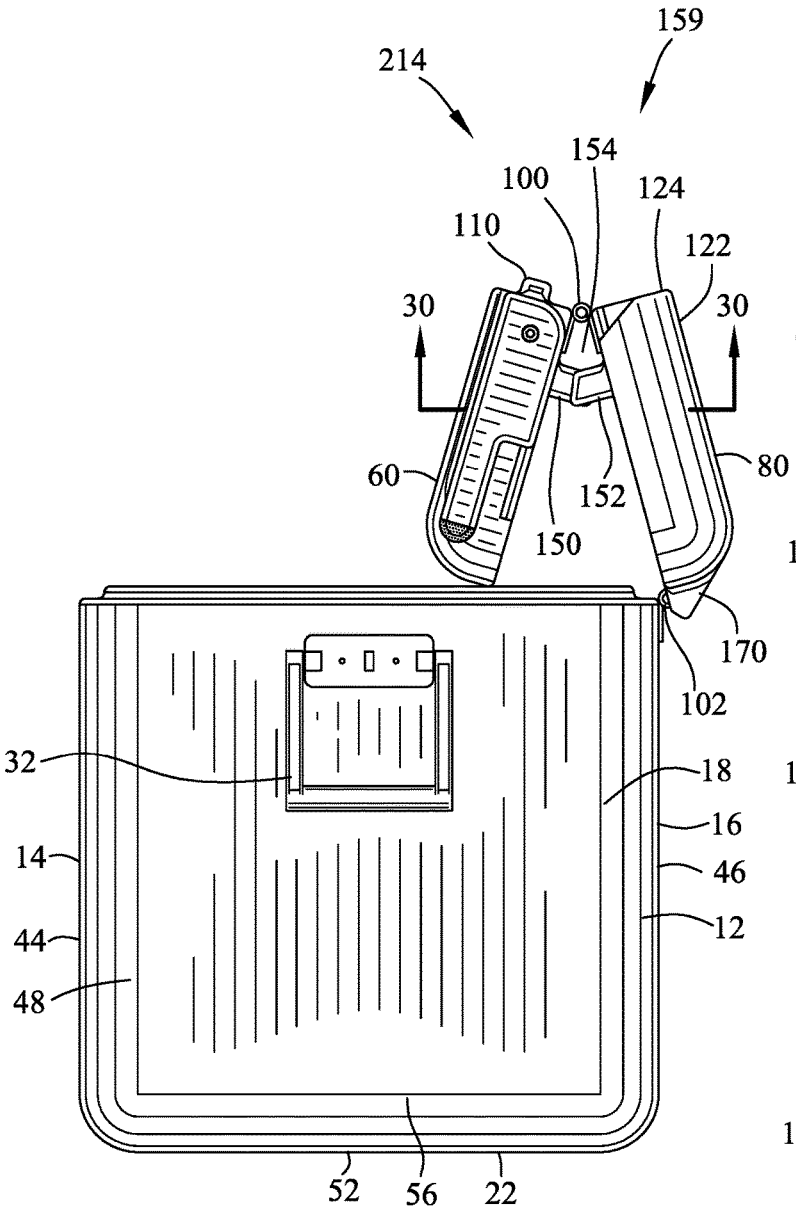
FIG. 29 is a view similar to FIG. 28 illustrating the first closure and the second closure including a further non linear orientation in the hinged closure and the first closure is abutting the hinged closure for supporting the hinged closure in a partially opened position and permitting access into the container.
Figure 30:
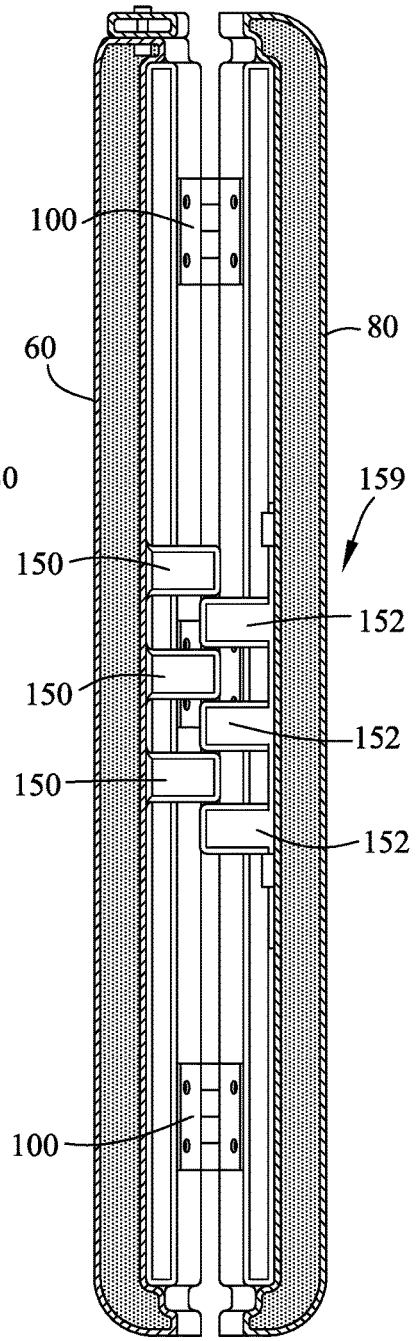
FIG. 30 is a sectional view along line 30-30 in FIG. 29 illustrating a first pivot stop and a second pivot stop in a non-engaging orientation.
Figure 31:
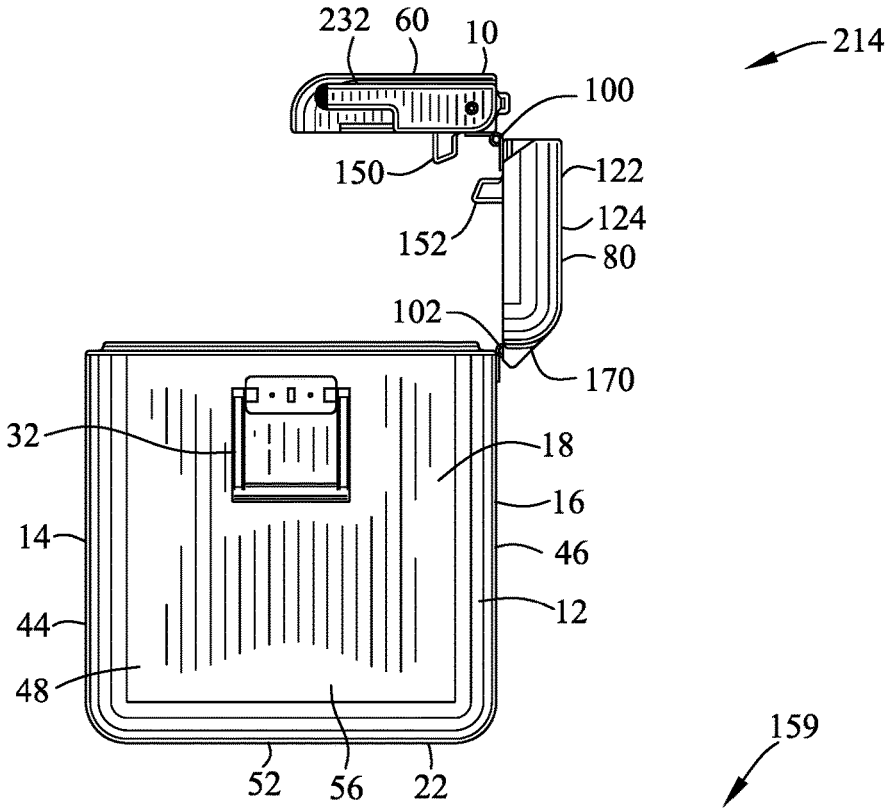
FIG. 31 is a view similar to FIG. 28 wherein the first closure includes a horizontal orientation and the secondary closure includes a vertical orientation.
Figure 32:
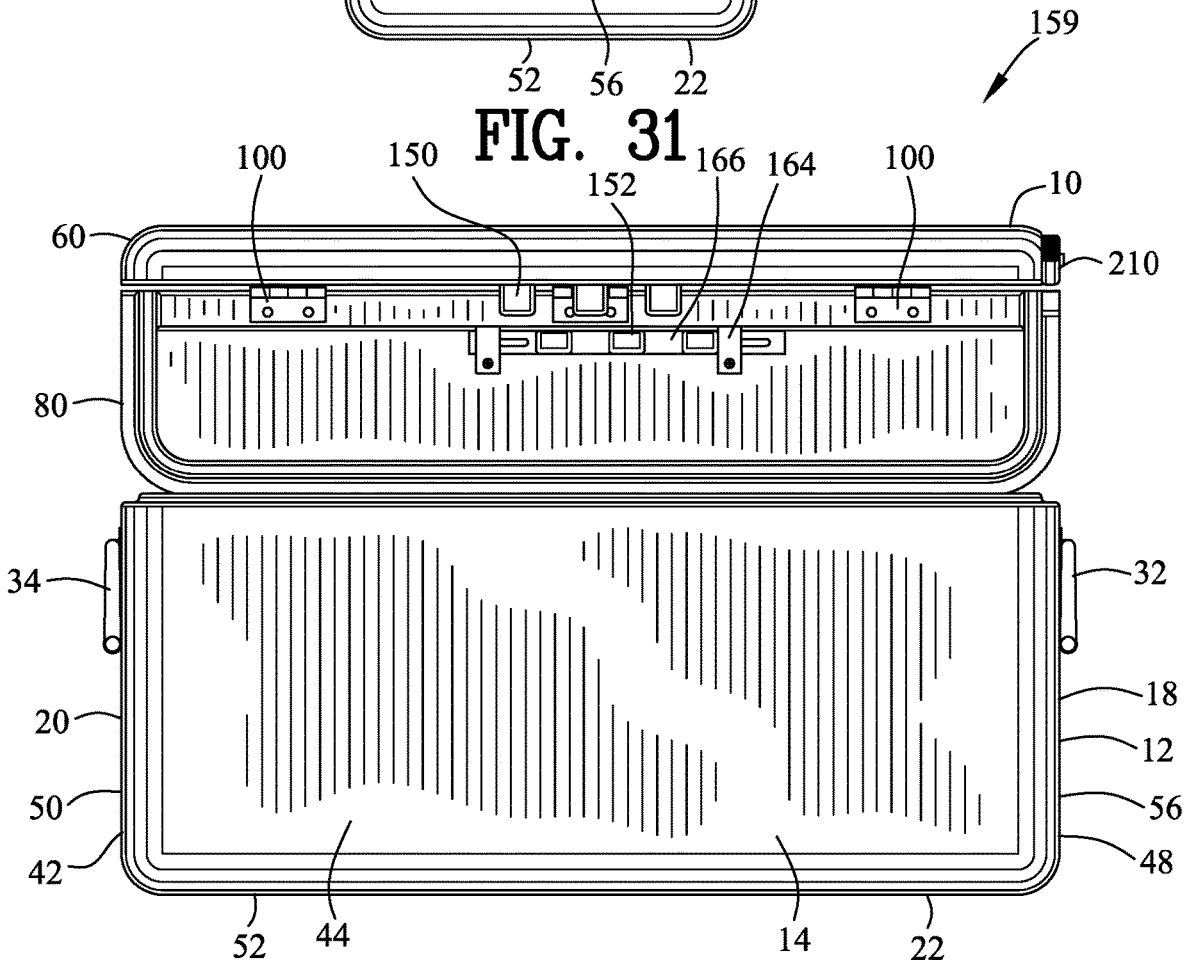
FIG. 32 is a left side view of FIG. 31.

The second closure 82 may further include a leg stop surface 240. As best shown in FIGS. 24, 52 and 53, the closure leg 210 abuts the leg stop surface 240 for positioning the closure leg 210 in the generally vertical orientation 242 when engaging the container 12 and supporting the linear closure 120 in the partially opened position 214 and permitting access into the container 12 and defining the second reduced closure height 216 relative to the container 12.

Figure 50:
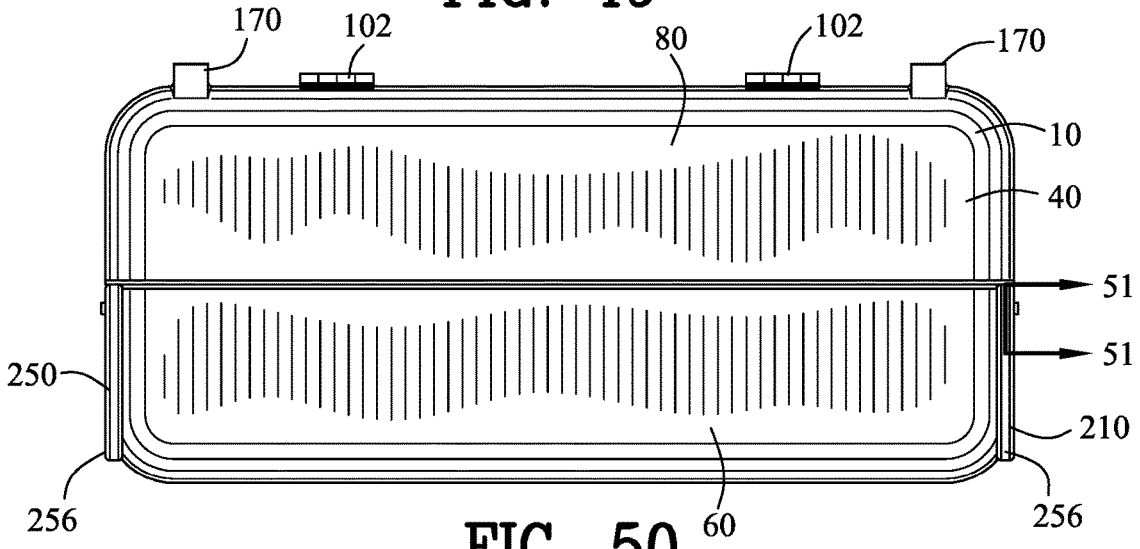
FIG. 50 is a top view of a fourth embodiment of the hinged closure engaging a container incorporating the present invention.
Figure 51:
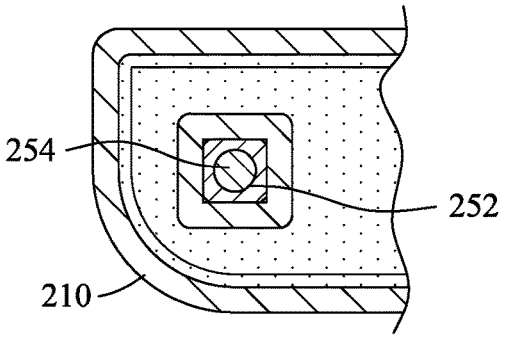
FIG. 51 is a sectional view along line 51-51 in FIG. 50 illustrating a leg rod extending between the closure leg and a second closure leg.

FIGS. 50-52 illustrate the hinged closure 10 further including the closure leg 210 being pivotably coupled to the first side 66 of the first closure 60. A second closure leg 250 is pivotably coupled to the second side 68 of the first closure 60. A rod aperture 252 extends between the first side 66 of the first closure 60 and the second side 68 of the first closure 60. A leg rod 254 rotates within the rod aperture 252 and is coupled to the closure leg 210 and the second closure leg 250. The leg rod 254 causes the closure leg 210 and the second closure leg 250 to remain in a parallel alignment 256 for simultaneously maintaining the closure leg 210 and the second closure leg 250 in the generally vertical orientation 242 and engaging the container 12 for supporting the linear closure 120 in the partially opened position 214, permitting access into the container 12 and defining the second reduced closure height 216 relative to the container 12.

FIGS. 42-49 and FIGS. 50-63 illustrate an alternative embodiment of the hinged closure 10. The hinged closure 10 includes a first closure 60 having an interior edge 62, an exterior edge 64, a first side 66, a second side 68, a lower surface 70 and an upper surface 72. A second closure 280 has a primary interior edge 282, a secondary interior edge 284, a first side 286, a second side 288, a lower surface 290 and an upper surface 292. A primary internal closure hinge 294 pivotably couples the interior edge 62 of the first closure 60 with the primary interior edge 282 of the second closure 280. A third closure 300 has an interior edge 302, an exterior edge 304, a first side 306, a second side 308, a lower surface 310 and an upper surface 312. A secondary internal closure hinge 314 pivotably couples the secondary interior edge 284 of the second closure 280 with the interior edge 302 of the third closure 300. The exterior closure hinge 102 pivotably couples the exterior edge 304 of the third closure 300 with the rear wall 16 of the container 12.

The hinged closure 10 includes a primary locking member 320 extending between interior edge 62 of the first closure 60 and the primary interior edge 282 of the second closure 280. The primary locking member 320 is engaged for preventing pivoting of the first closure 60 relative to the second closure 280 and defining a primary linear closure 322 within the first closure 60 and the second closure 280. The primary linear closure 322 covers the container chamber 24 and prevents access into the container chamber 24 of the container 12. The primary locking member 320 is disengaged for permitting pivoting of the first closure 60 relative to the second closure 280 and defining a primary nonlinear closure 324 within the first closure 60 and the second closure 280. The primary nonlinear closure 324 permits access into the container chamber 24 of the container 12 and defines a primary reduced closure height 326 relative to the container 12.

The hinged closure 10 further includes a secondary locking member 330 extending between secondary interior edge 284 of the second closure 280 and the interior edge 302 of the third closure 300. The secondary locking member 330 is engaged for preventing pivoting of the second closure 80 relative to the third closure 300 and defining a secondary linear closure 332 within the second closure 280 and the third closure 300. The secondary linear closure 332 covers the container chamber 24 and prevents access into the container chamber 24 of the container 12. The secondary locking member 330 is disengaged for permitting pivoting of the second closure 280 relative to the third closure 300 and defining a secondary nonlinear closure 334 within the second closure 280 and the third closure 300. The secondary nonlinear closure 334 permits access into the container chamber 24 of the container 12 and defines a secondary reduced closure height 336 relative to the container 12.

FIGS. 42-49 illustrate the primary locking member 320 including the first locking member 110 and the second locking member 112. The first locking member 110 may include a first male body 130 extending from the interior edge 62 of the first closure 60. The second locking member 112 may include a second female channel 132 recessed into the primary interior edge 282 of the second closure 280. The first male body 130 frictionally engages with the second female channel 132 for preventing pivoting of the first closure 60 relative to the second closure 280 and defining the primary linear closure 322 within the first closure 60 and the second closure 280. A pivotable force is applied to the first closure 60 while maintaining the second closure 280 in a static position for causing the first male body 130 to disengage with the second female channel 132 and permitting pivoting of the first closure 60 relative to the second closure 280 and defining the primary nonlinear closure 324 within the first closure 60 and the second closure 280.

The first male body 130 may include a base dimension 134 and a top dimension 136. Preferably, the base dimension 134 is slightly less than the top dimension 136 for defining a general male dove tale shape 138. The second female channel 132 may include an upper channel dimension 140 and a lower channel dimension 142. Preferably, the upper channel dimension 140 is slightly less than the lower channel dimension 142 for defining a general female dove tale shape 144. The engagement between the general male dove tale shape 138 and the general female dove tale shape 144 preventing inadvertent pivoting of the first closure 60 relative to the second closure 280 absent the pivotable force applied to the first closure 60 while maintaining the second closure 280 in a static position.

FIGS. 42-49 further illustrate the secondary locking member 330 including a third locking member 340 and the fourth locking member 342. The third locking member 340 may include a third male body 350 extending from the secondary interior edge 284 of the second closure 280. The fourth locking member 342 may include a fourth female channel 352 recessed into the interior edge 302 of the third closure 300. The third male body 350 frictionally engages with the fourth female channel 352 for preventing pivoting of the second closure 280 relative to the third closure 300 and defining the secondary linear closure 332 within the second closure 280 and the third closure 300. A pivotable force is applied to the second closure 280 while maintaining the third closure 300 in a static position for causing the third male body 350 to disengage with the fourth female channel 352 and permitting pivoting of the second closure 280 relative to the third closure 300 and defining the secondary nonlinear closure 334 within the second closure 280 and the third closure 300.

The third male body 350 may include a base dimension 134 and a top dimension 136. Preferably, the base dimension 134 is slightly less than the top dimension 136 for defining a general male dove tale shape 138. The fourth female channel 352 may include an upper channel dimension 140 and a lower channel dimension 142. Preferably, the upper channel dimension 140 is slightly less than the lower channel dimension 142 for defining a general female dove tale shape 144. The engagement between the general male dove tale shape 138 and the general female dove tale shape 144 prevent inadvertent pivoting of the second closure 280 relative to the third closure 300 absent the pivotable force applied to the second closure 280 while maintaining the third closure 300 in a static position.

The first pivot stop 150 is coupled to the lower surface 70 of the first closure 60. Preferably, the first pivot stop 150 is integrally formed with the first closure 60. The second pivot stop 152 is coupled to the lower surface 90 of the second closure 80. Preferably, the second pivot stop 152 in FIGS. 42-49 is a fixed second pivot stop 360 that is integrally formed with the second closure 80. The first pivot stop 150 abuts the second pivot stop 152 when the first closure 60 and the second closure 280 define the primary nonlinear closure 324 and a primary L-shape 362 with the first closure 60 and the second closure 280. The secondary nonlinear closure 334 defines a secondary L-shape 364 with the second closure 280 and the third closure 300. The primary L-shape 362 and the secondary L-shape 364 define a generally horizontal table surface 366 on the upper surface 292 of the second closure 280 and permits access into the container chamber 24 of the container 12 and defining a reduced closure height 368 relative to the container 12. The generally horizontal table surface 366 could be utilized for supporting the edible solid and/or liquid, or other objects that are utilized within the container 12. In addition, the generally horizontal table surface 366 could be utilized for preparing the edible solid and/or liquid, or other objects that may or may not be utilized within the container 12.

FIGS. 54-63 illustrate an alternative embodiment to the hinged closure 10. A hinged closure 10 includes the first closure 60 having a first interlocking step 380 having a first upper riser 382, a first tread 384 and a first lower riser 386. The second closure 280 abuts the first upper riser 382 and the first tread 384 in the primary linear closure 322.

Upon pivoting the first closure 60 ninety degrees to the second closure 280, the first lower riser 386 abuts the lower surface 290 of the second closure 280 for defining a primary pivot stop 390 and defining a primary L-shape 392 with the first closure 60 and the second closure 80.

The third closure 300 includes a third interlocking step 400 having a third upper riser 402, a third tread 404 and a third lower riser 406. The second closure 280 abuts the third upper riser 402 and the third tread 404 in the secondary linear closure 332.

Upon pivoting the third closure 300 ninety degrees to the second closure 280, the third lower riser 406 abuts the lower surface 290 of the second closure 280 for defining a secondary pivot stop 410 and defining a secondary L-shape 142 with the second closure 280 and the third closure 300. The primary L-shape 392 and the secondary L-shape 412 define a generally horizontal table surface 366 on the upper surface 292 of the second closure 280 and permits access into the container chamber 24 of the container 12 and defining a reduced closure height 368 relative to the container 12.

The closure stop 170 is coupled to the exterior edge 304 of the third closure 300. The closure stop 170 abuts the rear wall 16 of the container 12 for terminating pivoting the third closure 300 relative to the container 12 and define a generally right angle 420 between the third closure 300 and the rear wall 16 of the container 12. The generally right angle 420 maintains the generally horizontal table surface 366 on the upper surface 292 of the second closure 280 during the primary L-shape 392 and the secondary L-shape 412 and permits access into the container chamber 24 of the container 12 and defining the reduced closure height 368 relative to the container 12. Furthermore, the closure stop 170 engaging the rear wall 16 of the container 12 prevents the generally horizontal table surface 366 from pivoting clockwise and causing to fall any edible solid and/or liquid, or other objects that are resting on the generally horizontal table surface 366.

FIGS. 54-61 illustrate the primary locking member 320 including the first locking member 110 in the second closure 280 and a second locking member 112 in the first closure 60. The first locking member 110 includes a first locking pin 180 slidably engaging within the second closure 280. A first lock actuator channel 182 is in the upper surface 292 of the second closure 280. A first actuator 184 slidably engaging within the first lock actuator channel 182. The first actuator 184 is coupled to the first locking pin 180 for positioning the first locking pin 180 between a primary pin extended position 430 exterior to the primary interior edge 282 of the second closure 280 and a primary pin retracted position 432 interior to the primary interior edge 282 of the second closure 280.

The second locking member 112 includes a pin receiver 190 extending from the interior edge 62 and into the first closure 60. The first locking pin 180 engages with the pin receiver 190 for preventing pivoting of the first closure 60 relative to the second closure 280 and defines the primary linear closure 322 within the first closure 60 and the second closure 80. The first locking pin 180 disengages with the pin receiver 190 for permitting pivoting of the first closure 60 relative to the second closure 280 and defines the primary nonlinear closure 324 within the first closure 60 and the second closure 280.

By utilizing the first actuator 184 within the first lock actuator channel 182 in the upper surface 292 of the second closure 280, permits the activation of the first locking member 110 with the second locking member 112 from the outside of the hinged closure 10. The first locking member 110 and the second locking member 112 in FIGS. 54-63 may include a plurality of first locking members 110 and second locking members 112.

Similarly, the third locking member 340 includes a third locking pin 440 slidably engaging within the second closure 280. A second lock actuator channel 442 is in the upper surface 292 of the second closure 280. A second actuator 444 slidably engages within the second lock actuator channel 442. The second actuator 444 is coupled to the third locking pin 440 for positioning the third locking pin 440 between a secondary pin extended position 450 exterior to the secondary interior edge 284 of the second closure 280 and a secondary pin retracted position 452 interior to the secondary interior edge 284 of the second closure 280. The fourth locking member 342 includes a pin receiver 460 extending from the interior edge 302 and into the third closure 300. The third locking pin 440 engages with the pin receiver 460 for preventing pivoting of the second closure 280 relative to the third closure 300 and defines the secondary linear closure 332 within the second closure 280 and the third closure 300. The third locking pin 440 disengages with the pin receiver 460 for permitting pivoting of the second closure 280 relative to the third closure 300 and defines the secondary nonlinear closure 334 within the second closure 380 and the third closure 300.

FIGS. 64-75 illustrate a sixth embodiment of the present invention. The hinged closure 10 includes the first closure 60 having a primary corner closure 500, a secondary corner closure 502, a primary coupling leg 504, a secondary coupling leg 506 and a main coupling leg 508. The primary coupling leg 504, the secondary coupling leg 506 and the main coupling leg 508 define a general C-shape 510 for coupling the primary corner closure 500 and the secondary corner closure 502.

The second closure 80 or 280 has an interior edge 282, an exterior edge 84 or secondary interior edge 284, a first side 286, a second side 288, a lower surface 290 and an upper surface 292. A primary notch 520 intersects the first side 86 and the interior edge 82 of the second closure 80. A secondary notch 522 intersects the second side 88 and the interior edge 82 of the second closure 80. A primary internal closure hinge 294 pivotably couples the main coupling leg 508 of the first closure 60 with the second closure 280. An exterior closure hinge 102 may pivotably couple the exterior edge 84 of the second closure 80 with the rear wall 16 of the container 12. Alternatively, the exterior closure hinge 102 may pivotably couple the exterior edge 304 of the third closure 300 with the rear wall 16 of the container 12.

The primary corner closure 500 is positioned within the primary notch 520 and the secondary corner closure 502 is positioned within the secondary notch 522 for defining a primary linear closure 120 or 322 within the first closure 60 and the second closure 80 or 280. The primary linear closure 120 or 322 abuts the upper ledge 26 for covering the container chamber 24 and preventing access into the container chamber 24 of the container 12.

A first locking member 110 is coupled to the first closure 60. A second locking member 112 is coupled to the second closure 80 or 280. The first locking member 110 engages with the second locking member 112 for preventing pivoting of the first closure 60 relative to the second closure 80 or 280 and maintaining the primary linear closure 120 or 322 within the first closure 60 and the second closure 80 or 280. The first locking member 110 disengages with the second locking member 112 for permitting pivoting of the first closure 60 relative to the second closure 80 or 280 and defining a primary nonlinear closure 122 or 324 within the first closure 60 and the second closure 80 or 280.

Figure 74:
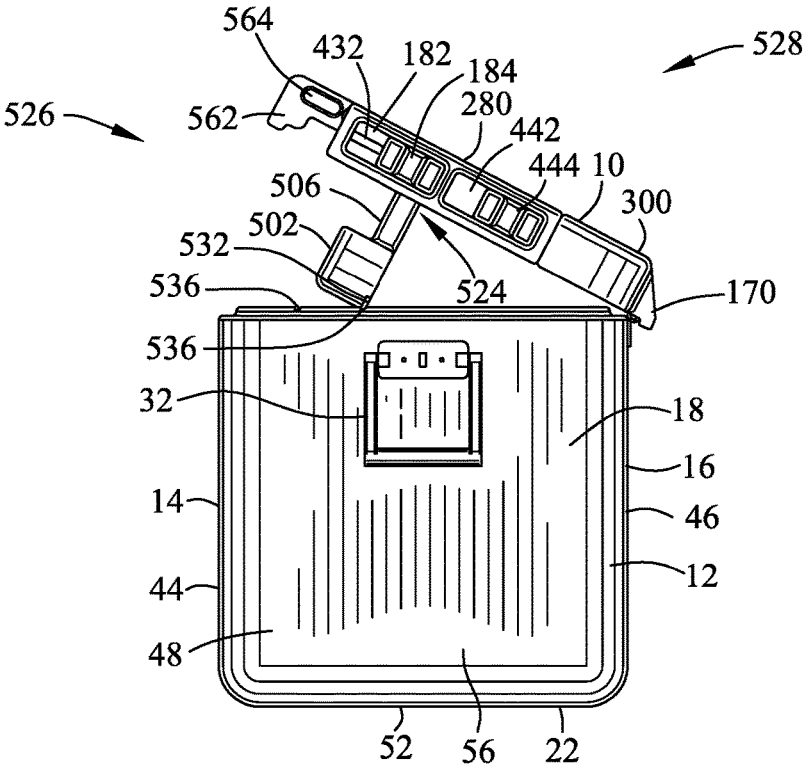
FIG. 74 is a similar view of FIG. 65 illustrating the first closure disengaged with the second closure and the first closure engaging with the upper ledge for permitting access into the container.
Figure 75:
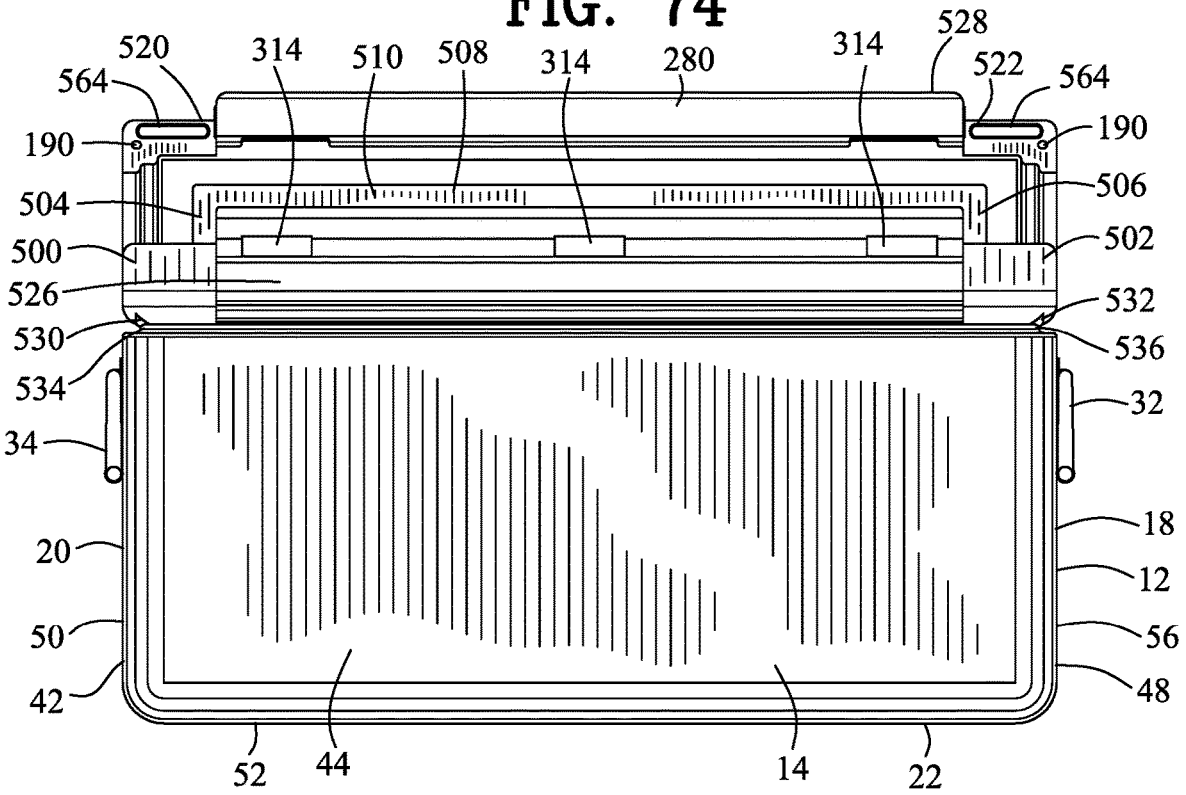
FIG. 75 is a front view of FIG. 74.

As best shown in FIGS. 74 and 75, the primary nonlinear closure 122 or 324 permits a closure angle 524 between the first closure 60 and the second closure 80 or 280. The closure angle 524 and the general C-shape 510 define a container access channel 526 with the first closure 60 and the front wall 14 of the container 12. The container access channel 526 permits access into the container chamber 24 of the container 12 and defining a reduced closure height 528 relative to the container 12.

Both the primary corner closure 500 and the secondary corner closure 502 include a rear interior surface 550 and a primary side interior surface 552. The rear interior surface 550 and the primary side interior surface 552 may include a recessed locking and aligning member 554. Both the primary notch 520 and the secondary notch 522 include a front interior surface 560 and a secondary side interior surface 562. The front interior surface 560 and the secondary side interior surface 562 may include a protruding locking and aligning member 564. The recessed locking and aligning member 554 engage with the protruding locking and aligning member 564 for aligning the first closure 60 with the second closure 80 or 280. The engagement between the recessed locking and aligning member 554 and the protruding locking and aligning member 564 may further serve to temporarily lock the first closure 60 with the second closure 80 or 280 before engagement between the first locking member 110 and the second locking member 112. In addition, engagement between the recessed locking and aligning member 554 and the protruding locking and aligning member 564 may further serve to provide a sealed engagement between the first closure 60 with the second closure 80 or 284 maintaining the thermal temperature within the container 12.

The primary corner closure 500 may include a first support tab 530 and the secondary corner closure 502 may include a second support tab 532. The upper ledge 26 of the container may include one or more first leg groove 534 in the first side wall 18. Similarly, the upper ledge 26 of the container may include one or more second leg groove 536 in the second side wall 20. As best shown in FIG. 74, the first supporting tab 530 may engage within the first leg groove 534 for preventing displacement of the primary corner closure 500 relative to the container 12 and maintaining the container access channel 526. The second supporting tab 532 may engage within the second leg groove 536 for preventing displacement of the secondary corner closure 502 relative to the container 12 and maintaining the container access channel 526.

The sixth embodiment in FIGS. 64-75 is similar to FIGS. 54-63 in that the first locking member 110 may include a primary pin channel 190 in the primary corner closure 500 and a secondary pin channel 190 in the secondary corner closure 502. The second locking member 112 may include a primary locking pin 180 slidably engaging within the second closure 80 or 280 and a secondary locking pin 180 slidably engaging within the second closure 80 or 280. The primary locking pin 180 engages with the primary pin channel 190 and the secondary locking pin 180 engages with the secondary pin channel 190 for preventing pivoting of the first closure 60 relative to the second closure 80 or 280 and defines the primary linear closure 322 within the first closure 60 and the second closure 80 or 280. The primary locking pin 180 disengages with the primary pin channel 190 and the secondary locking pin 180 disengages with the secondary pin channel 190 for permitting pivoting of the first closure 60 relative to the second closure 80 or 280 and defines the primary nonlinear closure 324 within the first closure 60 and the second closure 80 or 280.

The sixth embodiment in FIGS. 64-75 is similar to FIGS. 54-63 in that the hinged closure 10 may include a third closure 300 having an interior edge 302, an exterior edge 304, a first side 306, a second side 308, a lower surface 310 and an upper surface 312. A secondary internal closure hinge 314 pivotably couples the second closure 280 with the third closure 300. An exterior closure hinge 102 pivotably couples the exterior edge 304 of the third closure 300 with the rear wall 16 of the container 12.

The primary corner closure 500 is positioned within the primary notch 520 and the secondary corner closure 502 is positioned within the secondary notch 522 for defining a primary linear closure 322 within the first closure 60 and the second closure 280. The exterior edge 284 of the second closure 280 abuts the interior edge 302 of the third closure 300 for defining a secondary linear closure 332 within the second closure 280 and the third closure 300. The primary linear closure 322 and the secondary linear closure 332 abuts the upper ledge 26 for covering the container chamber 24 and preventing access into the container chamber 24 of the container 12.

The first locking member 110 engages with the second locking member 112 for preventing pivoting of the first closure 60 relative to the second closure 280 and maintains the primary linear closure 322 within the first closure 60 and the second closure 280. The first locking member 110 disengages with the second locking member 112 for permitting pivoting of the first closure 60 relative to the second closure 280 and defining a primary nonlinear closure 324 within the first closure 60 and the second closure 280. The primary nonlinear closure 324 permits a primary closure angle 524 between the first closure 60 and the second closure 280 as shown in FIGS. 71, 73, 74 and 75.

Figure 71:
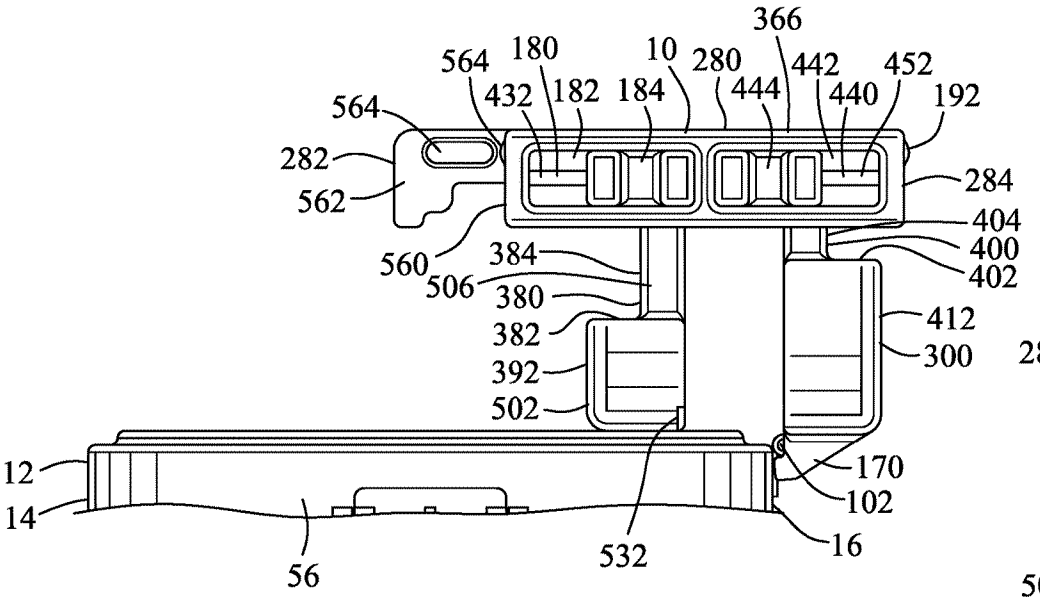
FIG. 71 is a similar view of FIG. 65 illustrating the first closure and the third closure including a vertical orientation and the second closure includes a horizontal orientation for defining a generally horizontal table surface on the second closure and permitting access into the container.
Figure 72:
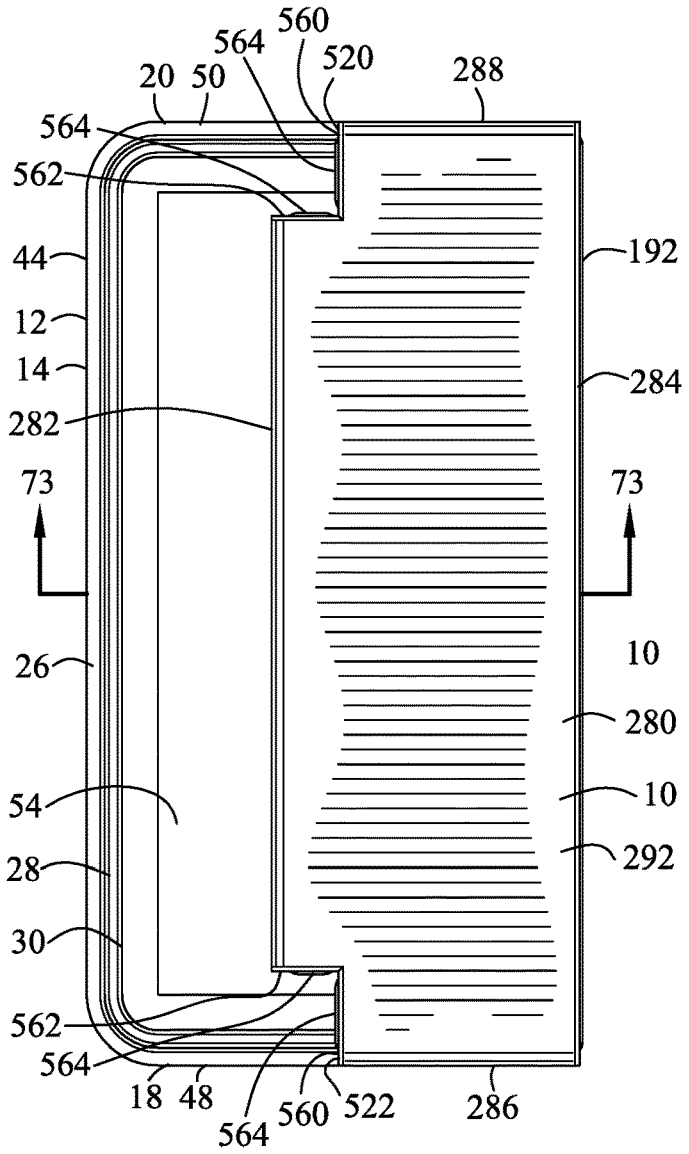
FIG. 72 is a top view of FIG. 71.
Figure 73:
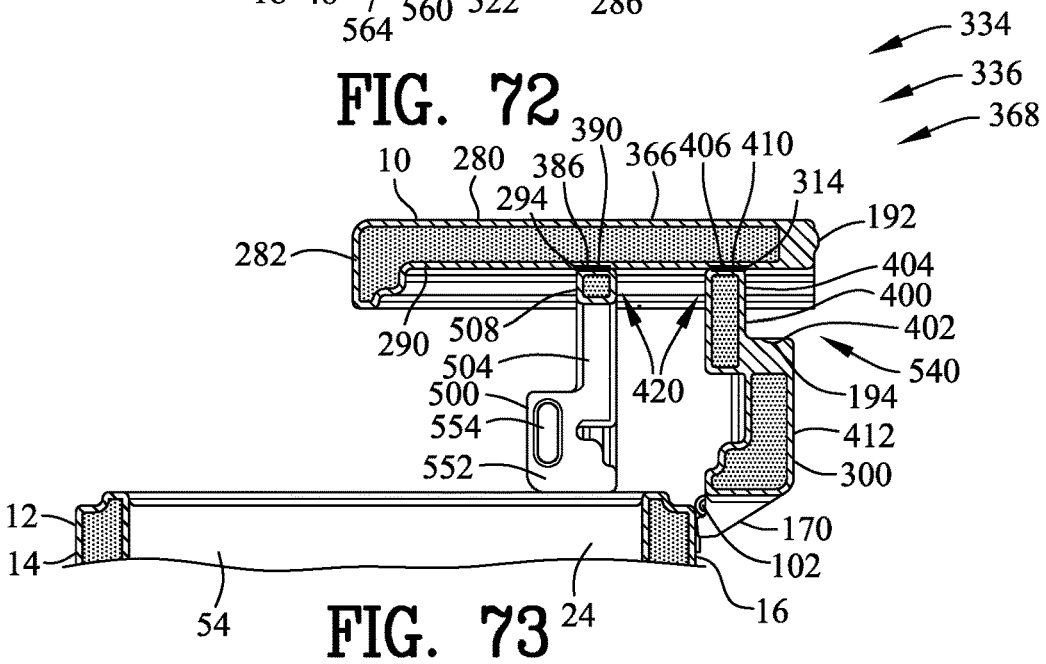
FIG. 73 is a sectional view along line 73-73 in FIG. 72.

A third locking member 340 is coupled to the second closure 280. A fourth locking member 342 is coupled to the third closure 300. The third locking member 340 engages with the fourth locking member 342 for preventing pivoting of the second closure 280 relative to the third closure 300 and maintains the secondary linear closure 332 within the second closure 280 and the third closure 300. The third locking member 340 disengages with the fourth locking member 342 for permitting pivoting of the second closure 280 relative to the third closure 300 and defines a secondary nonlinear closure 334 within the second closure 280 and the third closure 300. The secondary nonlinear closure 334 permits a secondary closure angle 540 between the second closure 280 and the third closure 300. As shown in FIGS. 71 and 73, the primary closure angle 524 and the secondary closure angle 540 define a container access channel 526 into the container chamber 24 of the container 12 and define a reduced closure height 528 relative to the container 12.

As best shown in FIGS. 71 and 73, the primary closure angle 524 and the secondary closure angle 540 define a generally horizontal table surface 366 on the upper surface 292 of the second closure 280. A secondary container access channel 526 is defined by the general C-shape 510 of the first closure 60 and the front wall 14 of the container 12 with the primary nonlinear closure 324 and the secondary nonlinear closure 334. The secondary container access channel 526 permits access into the container chamber 24 of the container 12 and defines a primary reduced closure height 528 relative to the container 12.

The sixth embodiment in FIGS. 64-75 is similar to FIGS. 54-63 in that the third locking member 340 may include a primary pin channel 460 in the third closure 300 and a secondary pin channel 460 in the third closure 300. The fourth locking member 342 includes a primary locking pin 440 slidalby engages within the second closure 280 and a secondary locking pin 440 slidably engages within the second closure 280. The primary locking pin 440 of the fourth locking member 342 engages with the primary pin channel 460 of the third locking member 340 for preventing pivoting of the second closure 280 relative to the third closure 300 and defining the secondary linear closure 332 within the second closure 280 and the third closure 300. The secondary locking pin 440 of the fourth locking member 342 disengages with the secondary pin channel 460 of the third locking member 340 for permitting pivoting of the second closure 280 relative to the third closure 300 and defining the secondary nonlinear closure 334 within the second closure 280 and the third closure 300.

The sixth embodiment in FIGS. 64-75 includes a first lock actuator channel 182 in the first side 286 of the second closure 280. A first actuator 184 slidably engages within the first lock actuator channel 182. The first actuator 184 is coupled to the primary locking pin 180 for positioning the first locking pin 180 between a primary pin extended position 430 exterior to the primary interior edge 282 of the second closure 280 and a primary pin retracted position 432 interior to the primary interior edge 282 of the second closure 280.

Similarly, a second lock actuator channel 182 is in the second side 288 of the second closure 280. A second actuator 202 slidably engages within the second lock actuator channel 182. The second actuator 202 is coupled to the secondary locking pin 180 for positioning the second locking pin 180 between a secondary pin extended position 430 exterior to the primary interior edge 282 of the second closure 280 and a secondary pin retracted position 432 interior to the primary interior edge 282 of the second closure 280.

A third lock actuator channel 442 is in the first side 286 of the second closure 280. A third actuator 444 slidably engages within the third lock actuator channel 442. The third actuator 444 is coupled to the primary locking pin 440 for positioning the third locking pin 440 between a secondary pin extended position 540 exterior to the secondary interior edge 284 of the second closure 280 and a secondary pin retracted position 452 interior to the secondary interior edge 284 of the second closure 284.

A fourth lock actuator channel 442 is in the second side 288 of the second closure 280. A fourth actuator 444 slidably engages within the fourth lock actuator channel 442. The fourth actuator 444 is coupled to the secondary locking pin 440 for positioning the second locking pin 440 between a secondary pin extended position 450 exterior to the secondary interior edge 284 of the second closure 280 and a secondary pin retracted position 452 interior to the secondary interior edge 284 of the second closure 280.

The first closure 60 may include a first interlocking step 380 having a first upper riser 382, a first tread 384 and a first lower riser 386. The second closure 280 abuts the first upper riser 382 and the first tread 384 in the primary linear closure 322. The first lower riser 386 abuts the lower surface 290 of the second closure 280 for defining a primary pivot stop 390 and defining a primary L-shape 392 with the first closure 60 and the second closure 280. The third closure 300 includes a third interlocking step 400 having an third upper riser 402, a third tread 404 and a third lower riser 406. The second closure 280 abuts the third upper riser 402 and the third tread 404 in the secondary linear closure 332. The third lower riser 406 abuts the lower surface 290 of the second closure 280 for defining a secondary pivot stop 410 and defining a secondary L-shape 412 with the second closure 280 and the third closure 300. The primary L-shape 392 and the secondary L-shape 412 define a generally horizontal table surface 366 on the upper surface 292 of the second closure 280 and permitting access into the container chamber 24 of the container 12 and defining a reduced closure height 368 relative to the container 12.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A hinged closure for a container, the container including a front wall, a rear wall, a first side wall, a second side wall and a bottom wall for defining a container chamber and a container aperture, the hinged closure, comprising:

a first closure having an interior edge, an exterior edge, a first side, a second side, a lower surface and an upper surface;

a second closure having an interior edge, an exterior edge, a first side, a second side, a lower surface and an upper surface;

an internal closure hinge pivotably coupling said interior edge of said first closure with said interior edge of said second closure;

an exterior closure hinge pivotally coupling said exterior edge of said second closure with the rear wall of the container;

a first locking member coupled to said interior edge of said first closure;

a second locking member coupled to said interior edge of said second closure;

said first locking member engaging with said second locking member for preventing pivoting of said first closure relative to said second closure and defining a linear closure within said first closure and said second closure and configured for permitting said linear closure to pivot relative to said exterior closure hinge and permitting access into the container chamber of the container;

said linear closure covering the container chamber and preventing access into the container chamber of the container;

said first locking member disengaging with said second locking member for permitting pivoting of said first closure relative to said second closure and defining a nonlinear closure within said first closure and said second closure and configured for permitting said nonlinear closure to pivot relative to said exterior closure hinge;

said nonlinear closure permitting access into the container chamber of the container and defining a reduced closure height relative tri the container;

a first pivot stop coupled to said lower surface of said first closure and extending from said lower surface of said first closure;

a second pivot stop coupled to said lower surface of said second closure and extending from said lower surface of said second closure;

said first pivot stop abutting said second pivot stop when said first closure and said second closure define said nonlinear closure for defining a generally horizontal table surface on said upper surface of said first closure and permitting access into the container chamber of the container and defining said reduced closure height relative to the container;

a second stop guide in said lower surface of said second closure for channeling the second pivot stop relative to the second closure;

said second pivot stop including a slide plate that slidably engaging within the second stop guide; and said second pivot stop and said slide plate configured for slidably engaging within said second stop guide for positioning said second pivot stop in an alignment orientation with said first pivot stop and permitting abutting of said first pivot stop with said second pivot stop and a non-alignment orientation with said first pivot stop and avoiding abutting of said first pivot stop with said second pivot stop.

2. The hinged closure for a container as set forth in claim 1, wherein said first locking member includes a first male body extending from said interior edge of said first closure;

said second locking member including a second female channel recessed into said interior edge of said second closure;

said first male body frictionally engaging with said second female channel for preventing pivoting of said first closure relative to said second closure and defining said linear closure within said first closure and said second closure; and said first male body disengaging with said second female channel for permitting pivoting of said first closure relative to said second closure and defining said nonlinear closure within said first closure and said second closure.

3. The hinged closure for a container as set forth in claim 1, further including a closure stop coupled to said exterior edge of said second closure;

said closure stop abutting the rear wall of the container for terminating pivoting said second closure relative to the container and maintaining said generally horizontal table surface on said upper surface of said first closure during said first pivot stop abutting said second pivot stop and permitting access into the container chamber of the container and defining said reduced closure height relative to the container.

4. The hinged closure for a container as set forth in claim 1, wherein said first locking member includes a first locking pin slidably engaging within said first closure;

a first lock actuator channel in said upper surface of said first closure;

a first actuator slidably engaging within said first lock actuator channel;

said first actuator coupled to said first locking pin for positioning said first locking pin between a pin extended position exterior to said interior edge of said first closure and a pin retracted position interior to said interior edge of said first closure;

said second locking member includes a pin receiver extending from said interior edge and into said second closure;

said first locking pin engaging with said pin receiver for preventing pivoting of said first closure relative to said second closure and defining said linear closure within said first closure and said second closure; and said first locking pin disengaging with said pin receiver for permitting pivoting of said first closure relative to said second closure and defining said nonlinear closure within said first closure and said second closure.

5. The hinged closure for a container as set forth in claim 1, further including a second pivot stop channel in said upper surface of said second closure;

a second actuator slidably engaging within said second pivot stop channel; and said second actuator coupled to said second pivot stop for displacing said second pivot stop in said alignment orientation with said first pivot stop and permitting abutting of said first pivot stop with said second pivot stop and said non-alignment orientation with said first pivot stop and avoiding abutting of said first pivot stop with said second pivot stop.

6. The hinged closure for a container as set forth in claim 1, further including a closure leg pivotally coupled to said first closure for supporting said linear closure in a partially opened position.

7. The hinged closure for a container as set forth in claim 6, further including a leg channel in said first side of said first closure; and said closure leg positioned within said leg channel for defining a linear side surface with said closure leg and said first side of said first closure.

8. The hinged closure for a container s set forth in claim 6, further including a stop surface in said second closure; and said closure leg abutting said leg stop surface for positioning said closure leg and supporting said linear closure in said partially opened position.

9. The hinged closure for a container as set forth in claim 6, further including a first leg retainer coupled to said first closure;

a second leg retainer in said closure leg; and said first leg retainer engaging said second leg retainer for maintaining said closure leg in a parallel orientation with said first closure for permitting said first closure and said second closure to fully engage with the container in said linear closure.

* * * * *